US008400487B2

(12) United States Patent
Imai

(10) Patent No.: US 8,400,487 B2
(45) Date of Patent: Mar. 19, 2013

(54) PRINTER AND PRINTING METHOD

(75) Inventor: Ryo Imai, Saitama (JP)

(73) Assignee: FUJIFILM Corporation, Tokyo (JP)

( * ) Notice: Subject to any disclaimer, the term of this patent is extended or adjusted under 35 U.S.C. 154(b) by 352 days.

(21) Appl. No.: 12/893,757

(22) Filed: Sep. 29, 2010

(65) Prior Publication Data

US 2011/0074906 A1 Mar. 31, 2011

(30) Foreign Application Priority Data

Sep. 30, 2009 (JP) ..... 2009-226582

(51) Int. Cl.
*B41J 11/00* (2006.01)
*B41J 2/32* (2006.01)

(52) U.S. Cl. ..... 347/218; 347/171

(58) Field of Classification Search ..... 347/171, 347/187, 198, 215, 218
See application file for complete search history.

(56) References Cited

U.S. PATENT DOCUMENTS 5,645,362 A * 7/1997 Aizawa et al. ..... 347/215
5,764,266 A * 6/1998 Azuma et al. ..... 347/218
6,133,928 A * 10/2000 Kayashima et al. ..... 347/171
6,459,470 B1 * 10/2002 Iwano et al. ..... 358/3.27
7,543,910 B2 6/2009 Suzuki

FOREIGN PATENT DOCUMENTS

JP 2007-127521 A 5/2007
JP 2007-144974 A 6/2007

* cited by examiner

*Primary Examiner* — Kristal Feggins
(74) *Attorney, Agent, or Firm* — Sughrue Mion, PLLC

(57) ABSTRACT

A clamper clamps an edge of a lenticular sheet and is transported in a sub-scanning direction. After oblique transportation of the lenticular sheet is corrected based on a detection result from an oblique transportation detector, transportation of the lenticular sheet for forming an image receptor layer on the rear side of the lenticular sheet is performed with a thermal head contacting said lenticular sheet. In this transportation, a lens sensor is activated to optically detect a lens pitch and so on. The lens sensor is positioned between the thermal head and the clamper.

26 Claims, 19 Drawing Sheets

PRINTER AND PRINTING METHOD

BACKGROUND OF THE INVENTION

1. Field of the Invention

The present invention is related to a printer and a printing method for recording an image on a lenticular sheet.

2. Description of the Related Arts

A technique for observing a stereo image with use of a lenticular sheet where a plurality of lenticular lenses in a shape of a semicircular are arranged in a lateral direction is known. For observing the stereo image, for example, one of whole images taken from two viewpoints in the lateral direction is sliced into linear images (stripes), and then the stripes are interlaced with stripes sliced from the other of the whole images. These are printed on the rear side of the lenticular sheet such that each stripe is printed on a corresponding lenticular lens. Accordingly, the stereo image can be observed since a left eye sees one of the whole images and a right eye sees the other whole image having parallax with the former one. In addition, a technique for observing a stereo image with an enhanced stereoscopic effect by use of N ($N \geqq 3$) images from different viewpoints is also known. In this technique, each of N whole images is sliced into stripes, and these stripes are aligned on the lenticular lenses in sequential order.

As a method for positioning the linear images on the rear side of the lenticular sheet, there is a method that a print (hard copy) where all linear images are arranged and printed is attached on the rear side of the lenticular sheet. In addition, some printers utilize a method that the linear images are directly printed on the rear side of the lenticular sheet.

In case that the image is directly recorded on the rear side of the lenticular sheet, a position of the image must be correctly adjusted on a position of the lenticular lens (hereinafter called as the lens position). In addition, detection of a lens pitch is required in this case. For this purpose, some printers, for example printers of U.S. Pat. No. 7,543,910 (corresponding to Japanese Laid-open Patent Publication No. 2007-144974) and Japanese Laid-open Patent Publication No. 2007-127521, provide an optical sensor near a recording head for detecting a position of the lenticular lens during transportation in a main-scanning direction so that operation of the recording head is controlled (for example discharge timing of ink is controlled).

On the other hand, there are thermal printers which use a thermal head for recording an image. As the thermal printer, there are a heat-sensitive type in which a heater element array of the thermal head directly heats a thermosensitive recording sheet for coloring, a thermofusible type in which a rear side of an ink ribbon is heated so that ink on the ink ribbon is transferred, and a sublimation type in which an ink is sublimated for adhesion.

However, in case the thermal head is used for recording an image directly on the lenticular sheet, it is difficult that the optical sensor for detecting the lens pitch and so on is provided near the thermal head, since the thermal head has a high temperature in recording. In addition, since the thermal head presses a recording medium for recording and tension is occurred on the lenticular sheet from a part pressed by the thermal head, it is possible that the lens pitch is changed because the lenticular sheet is stretched by the tension. Accordingly, in some measurement positions, the lens pitch required for controlling a recording position of an image cannot be correctly measured. The printers of U.S. Pat. No. 7,543,910 (corresponding to Japanese Laid-open Patent Publication No. 2007-144974) and Japanese Laid-open Patent Publication No. 2007-127521 disclose no solution for these problems.

SUMMARY OF THE INVENTION

An object of the present invention is to provide a printer and a printing method which enable to correctly measure a lens pitch and so on required for controlling a recording position of an image when a thermal head is used for recording the image on a lenticular sheet.

In order to achieve the above and other objects, a printer of the present invention comprises a sheet transporter, a recorder, a lens sensor and a lens detector. The sheet transporter includes a clamper for clamping an edge of a lenticular sheet having a plurality of lenticular lenses and moves the clamper in a sub-scanning direction for transporting the lenticular sheet. The recorder has a thermal head movable between a pressing position where the thermal head presses a rear side of an ink film superimposed on a rear side of the lenticular sheet and a retreat position where the thermal head is apart from the rear side of the ink film, and records an image on the rear side of the lenticular sheet such that lines elongated in the main-scanning direction are recorded sequentially in synchronization with the transportation of the lenticular sheet, with use of the thermal head at the pressing position which heats the ink film so that ink is sublimated from the ink film and adhered on the rear side of the lenticular sheet. The lens sensor is positioned between the thermal head and the clamper and optically detects the lenticular sheet. The lens detector calculates a lens pitch on the lenticular sheet clamped by the clamper based on the detection result from the lens sensor, when the thermal head is at the pressing position.

It is preferable that the lens sensor outputs detection signal according to which position on a concave-convex surface of the lenticular sheet, while the sheet transporter transports the lenticular sheet.

It is preferable that the recorder forms a transparent image receptor layer on which the ink will be adhered, on the rear side of the lenticular sheet before recording the image with use of the ink film, that the sheet transporter transports the lenticular sheet from upstream side to downstream side from the thermal head for forming the image receptor layer, and then transports the lenticular sheet again from upstream side to downstream side from the thermal head for recording the image with use of the ink film, and that the lens detector calculates the lens pitch based on the detection result from the lens sensor while the lenticular sheet is transported for forming the image receptor layer.

It is preferable that the lens detector calculates the lens pitch based on the detection result from the lens sensor, before the thermal head reaches a recording area on which the image will be recorded by the thermal head, while the sheet transporter transports the lenticular sheet from upstream side to downstream side from the thermal head for recording the image with use of the ink film.

It is preferable that the printer further comprises a rotation mechanism which rotates the clamper on a transportation surface of the lenticular sheet, and a rotation controller which optically detects an inclination of the lenticular lens on the lenticular sheet clamped by the clamper from the main-scanning direction, and controls the rotation mechanism based on the detection result so that a longitudinal direction of the lenticular lens becomes parallel to the main-scanning direction.

It is preferable that the lens detector detects the lens pitch after the longitudinal direction of the lenticular lens is adjusted to be parallel to the main-scanning direction by the rotation controller.

It is preferable that the printer further comprises a rotation mechanism which rotates the clamper on a transportation surface of the lenticular sheet, and a rotation controller which optically detects an inclination of the lenticular lens on the lenticular sheet clamped by the clamper from the main-scanning direction, and controls the rotation mechanism to rotate the clamper based on the detected inclination after the image receptor layer is formed, so that the longitudinal direction of the lenticular lens becomes parallel to the main-scanning direction. The recorder forms the image receptor layer on an area larger than a recording area on which the image will be recorded.

It is preferable that the lens sensor has first to third sensors arranged in the main-scanning direction to output detection signal according to which position on a concave-convex surface of the lenticular sheet, with an interval between the first and second sensors determined such that a displacement length between detection positions of the first and second lens sensors against the lenticular sheet does not reach a length equal to or more than one lens pitch regardless of a degree of oblique transportation of the lenticular sheet, and that the rotation controller performs steps of identifying, calculating and correcting. In the identifying step, detection signal, which represents that the third sensor detects a specific place arbitrarily selected on the lenticular lens which is previously detected by the first sensor is identified based on a transportation length from a point when the first sensor detects the specific place to a point when the second sensor outputs detection signal which represents that the second sensor detects the specific place, the interval between the first and second sensors, and an initial lens pitch. In the calculating step, an oblique transportation angle of the lenticular sheet is calculated based on a transportation length from the point when the first sensor detects the specific place to a point when the third sensor outputs detection signal which represents that the third sensor detects the specific place, and an interval between the first and third sensors. In the correcting step, the oblique transportation is corrected by rotating the clamper based on the oblique transportation angle.

It is preferable that the lens detector measures the lens pitch of the lenticular sheet by measuring a transportation length corresponding to one cycle of detection signal from one of the first to third sensors and correcting the measured transportation length with use of the oblique transportation angle.

It is preferable that the rotation controller has a reference line parallel to the main-scanning direction and an oblique transportation sensor facing to the reference line through the lenticular sheet for detecting an image observed through the lenticular sheet, and corrects the oblique transportation of the lenticular sheet by rotating the clamper with reference to output from the oblique transportation sensor so that a striped pattern observed as the image is disappeared.

It is preferable that the printer further comprises a reference line, a rotation mechanism and a rotation controller. The reference line is parallel to the main-scanning direction, faces to the lens sensor and has a width narrower than the lens pitch. The rotation mechanism rotates the clamper on a transportation surface of the lenticular sheet. The rotation controller controls the rotation mechanism based on the detection result from the lens sensor so that the longitudinal direction of the lenticular lens becomes parallel to the main-scanning direction. The lens sensor detects an image of the reference line observed through the lenticular sheet, and the rotation controller corrects the oblique transportation of the lenticular sheet by rotating the clamper with reference to output from the lens sensor so that a striped pattern observed as the image is disappeared.

It is preferable that the lens detector detects the lens pitch based on the striped pattern detected by the lens sensor while the lenticular sheet is obliquely transported.

It is preferable that the lens detector drives the sheet transporter to transport the lenticular sheet to a position where the center of the lenticular lens coincides with the reference line such that the reference line is detected as an image with constant density by the lens sensor, after the oblique transportation of the lenticular sheet is corrected by the rotation controller, so that the position is used as a reference for obtaining a positional relationship between the lenticular sheet and the thermal head.

It is preferable that the printer further comprises a displacement angle detector and a memory. The displacement angle detector records a test image elongated in the main-scanning direction and having a certain width in the sub-scanning direction on a transparent recording sheet while the sheet transporter transports the recording sheet clamped by the clamper, and then detects a displacement angle between the reference line and the main-scanning direction based on a difference between a transportation length until the test image reaches a measurement point determined on the reference line and a transportation length until the test image reaches another measurement point determined on the reference line, and an interval between the two measurement points. The memory stores the detected displacement angle. The rotation controller corrects a rotational position of the clamper with use of the displacement angle stored in the memory.

It is preferable that the printer further comprises reference lines, a rotation mechanism and a rotation controller. The reference lines are arranged in the sub-scanning direction with an interval narrower than the lens pitch and are parallel to the main-scanning direction, and each of which faces to the lens sensor and has a width narrower than the lens pitch. The rotation mechanism rotates the clamper on a transportation surface of the lenticular sheet. The rotation controller controls the rotation mechanism based on the detection result from the lens sensor so that the longitudinal direction of the lenticular lens becomes parallel to the main-scanning direction. The lens sensor detects an image of the reference lines observed through the lenticular sheet, and the rotation controller corrects the oblique transportation of the lenticular sheet by rotating the clamper with reference to output from the lens sensor so that a moire observed with the image is disappeared.

It is preferable that the lens detector drives the sheet transporter to transport the lenticular sheet to a position where the center of the lenticular lens coincides with the reference line such that a center in the sub-scanning direction of an image of the reference lines detected by the lens sensor has the highest density, after the oblique transportation of the lenticular sheet is corrected by the rotation controller, so that the position is used as a reference for obtaining a positional relationship between the lenticular sheet and the thermal head, and calculates a transportation length corresponding to one cycle of change of density distribution of the image, as a lens pitch.

According to a preferable embodiment of the present invention, a printer comprises a sheet transporter, a recorder, a rotation mechanism, and a rotation controller. The sheet transporter includes a clamper for clamping an edge of a lenticular sheet having a plurality of lenticular lenses, and moves the clamper in a sub-scanning direction for transporting the lenticular sheet. The recorder has a recording head for recording lines elongated in a main-scanning direction on a rear side of the lenticular sheet, and records the lines sequentially in synchronization with the transportation of the lenticular sheet, such that an image is recorded on the rear side of the lenticular sheet. The rotation mechanism rotates the clamper on a transportation surface of the lenticular sheet. The rotation controller optically detects an inclination of a longitudinal direction of the lenticular lens on the lenticular sheet clamped by the clamper from the main-scanning direction, and controls the rotation mechanism based on the detection result so that the longitudinal direction of the lenticular lens becomes parallel to the main-scanning direction.

Preferably, the printer further comprises a lens sensor. The lens sensor has first to third sensors which are arranged in the main-scanning direction between the recording head and the clamper, each of the first to third sensors optically detecting the lenticular sheet and outputting detection signal according to which position on a concave-convex surface of the lenticular sheet, with an interval between the first and second sensors determined such that a displacement length between detection positions of the first and second sensors against the lenticular sheet does not reach a length equal to or more than one lens pitch regardless of a degree of oblique transportation of the lenticular sheet. The rotation controller preferably performs steps of identifying, calculating, and correcting. In the identifying step, detection signal, which represents that the third sensor detects a specific place arbitrarily selected on the lenticular lens which is previously detected by the first sensor, is identified based on a transportation length from a point when the first sensor detects the specific place to a point when the second sensor outputs detection signal which represents that the second sensor detects the specific place, the interval between the first and second sensors, and an initial lens pitch. In the calculating step, an oblique transportation angle of the lenticular sheet is calculated based on a transportation length from the point when the first sensor detects the specific place to a point when the third sensor outputs detection signal which represents that the third sensor detects the specific place, and an interval between the first and third sensors. In the correcting step, the oblique transportation is corrected by rotating the clamper based on the oblique transportation angle.

Preferably, the rotation controller has a reference line parallel to the main-scanning direction and an oblique transportation sensor facing to the reference line through the lenticular sheet for detecting an image observed through the lenticular sheet, and corrects the oblique transportation of the lenticular sheet by rotating the clamper with reference to output from the oblique transportation sensor so that a striped pattern observed as the image is disappeared.

It is preferable that a width of the reference line is narrower than the lens pitch. It is preferable that the oblique transportation sensor is positioned between the recording head and the clamper.

Preferably, the printer further comprises a displacement angle detector and a memory. The displacement angle detector records a test image elongated in the main-scanning direction and having a certain width in the sub-scanning direction on a transparent recording sheet by the recording head while the sheet transporter transports the recording sheet clamped by the clamper, and then detects a displacement angle between the reference line and the main-scanning direction based on a difference between a transportation length until the test image reaches a measurement point determined on the reference line and a transportation length until the test image reaches another measurement point determined on the reference line, and an interval between the two measurement points. The memory preferably stores the detected displacement angle. The rotation controller preferably corrects a rotational position of the clamper with use of the displacement angle stored in the memory.

Preferably, the printer further comprises a lens sensor and reference lines. The lens sensor is positioned between the recording head and the clamper, and optically detects the lenticular sheet. The reference lines are arranged in the sub-scanning direction with an interval narrower than the lens pitch and are parallel to the main-scanning direction, and each of which faces to the lens sensor and has a width narrower than the lens pitch. The lens sensor preferably detects an image of the reference lines observed through the lenticular sheet. The rotation controller preferably corrects the oblique transportation of the lenticular sheet by rotating the clamper with reference to output from the lens sensor so that a moire observed with the image is disappeared.

A printing method of the present invention comprises a step of calculating a lens pitch by optically detecting an area between a clamper and the thermal head on the lenticular sheet which is clamped by the clamper which moves for transporting the lenticular sheet and is pressed by the thermal head.

It is preferable that the clamper, which clamps an edge of the lenticular sheet and transports the lenticular sheet in the sub-scanning direction, is rotated based on the detection result so that a longitudinal direction of the lenticular lens becomes parallel to the main-scanning direction.

According to a preferable embodiment of the present invention, a printing method comprises a step of optically detecting an inclination of a longitudinal direction of the lenticular lens from the main-scanning direction, and rotating a clamper which clamps an edge of the lenticular sheet and transports the lenticular sheet in the sub-scanning direction, so that the longitudinal direction of the lenticular lens becomes parallel to the main-scanning direction.

According to the present invention, since the lens pitch is calculated by optically detecting an area between the clamper and the thermal head while the clamper for transportation clamps the lenticular sheet and the thermal head presses the lenticular sheet, the lens pitch required for controlling a recording position of an image can be correctly measured based on actual recording conditions.

BRIEF DESCRIPTION OF THE DRAWINGS

The above and other subjects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE PREFERRED EMBODIMENTS

First Embodiment

Figure 1:
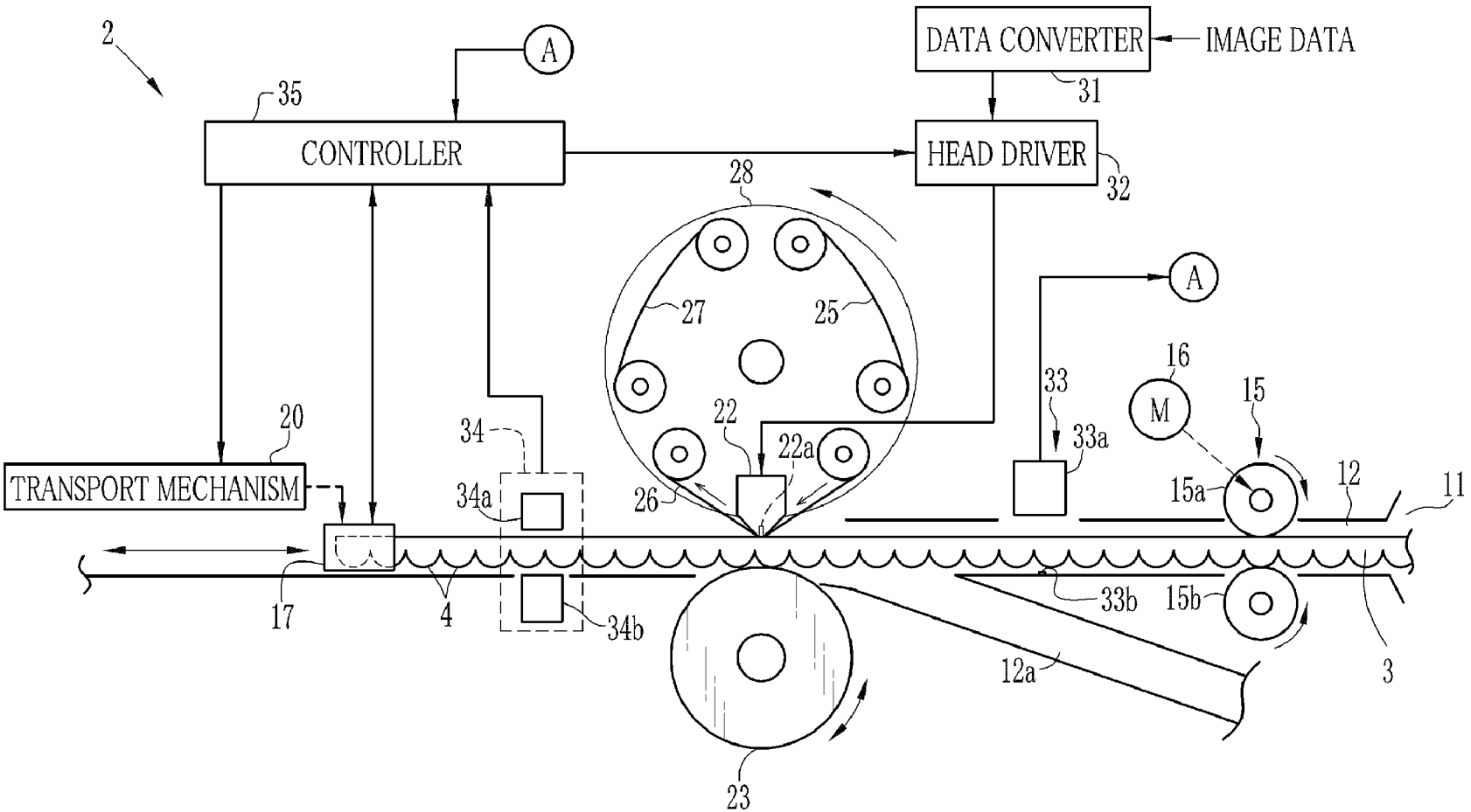
FIG. 1 is an explanatory drawing which illustrates an outline of a printer of the present invention.

FIG. 1 illustrates an outline of a printer of the first embodiment of the present invention. A printer 2 records parallax images on the rear side of a lenticular sheet 3 with use of a sublimation method, for observing a stereo image. The printer 2 converts parallax images of two viewpoints into parallax images of six viewpoints, and records the parallax images of six viewpoints on the lenticular sheet 3.

Figure 2:
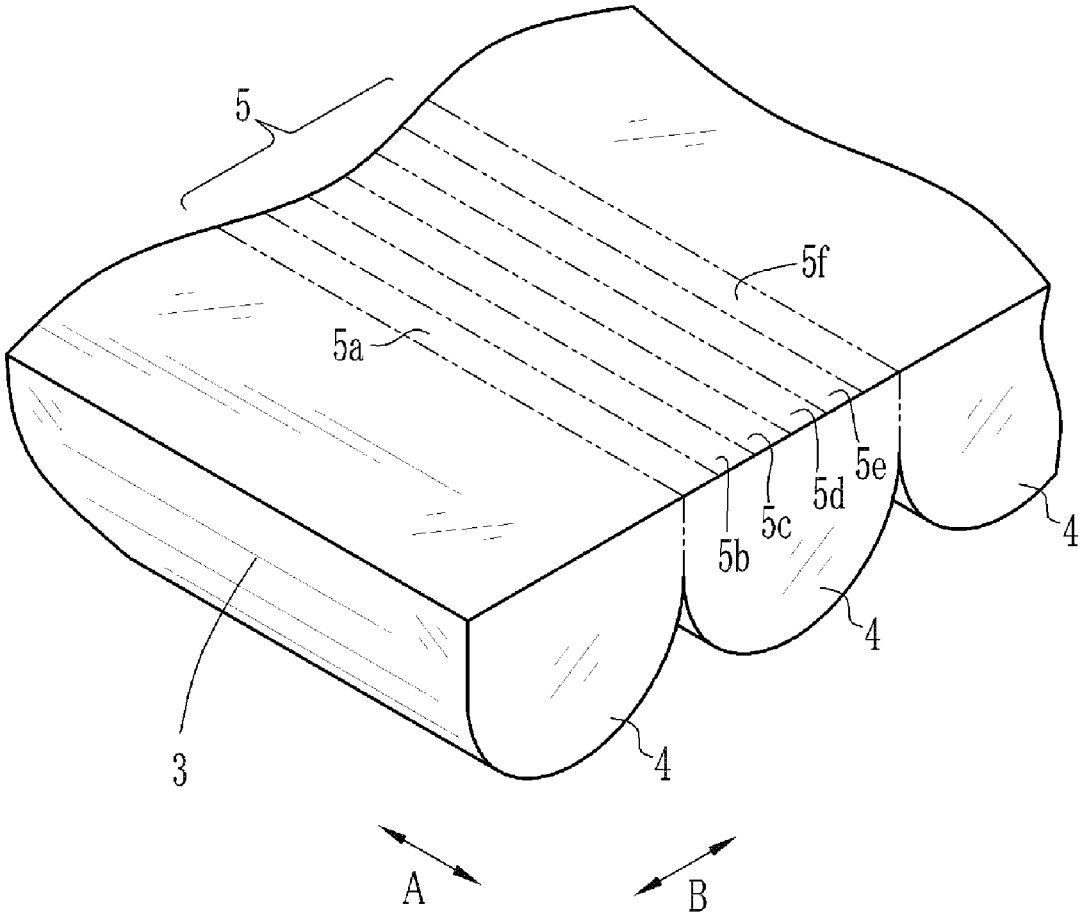
FIG. 2 is a perspective view of a lenticular sheet.

As illustrated in FIG. 2, the lenticular sheet 3 has a plurality of lenticular lenses (hereinafter referred to as the lenses) 4 in the shape of a semicircular column arranged on the front side, and has a flat surface on the rear side. On the lenticular sheet 3, the lenses 4 extending in the direction of an arrow A (illustrated in FIG. 2) are arranged at a pitch of 100 LPI (Line Per Inch) in the direction of an arrow B (illustrated in FIG. 2, hereinafter referred to as the arrangement direction). Accordingly, the length of the lens 4 in the arrangement direction is approximately 254 μm, and the lens pitch is also approximately 254 μm. The longitudinal direction (the direction of the arrow A) of the lens 4 is the vertical direction for observing the stereo image, and the arrangement direction of the lens 4 is the horizontal direction for observing the stereo image.

The rear side of the lenticular sheet 3 is imaginary partitioned into image areas 5 each one of which is corresponding to each one of the lenses 4. The image area 5 is divided into a first to sixth minute areas 5*a* to 5*f* along the arrangement direction, each of the minute areas 5*a* to 5*f* is corresponding to each one of the six viewpoints for displaying a stereo image. On the each minute area, a linear image, which is one of linearly divided parts of a parallax image, is recorded. Each of the minute areas 5*a* to 5*f* corresponds to each of six parallax images. For example, the first minute area 5*a* corresponds to the parallax image of the first viewpoint, and a linear image from the parallax image of the first viewpoint is recorded on the first minute area 5*a*. Similarly, the second minute area 5*b* corresponds to the parallax image of the second viewpoint, and a linear image from the parallax image of the second viewpoint is recorded on the second minute area 5*b*.

As illustrated in FIG. 1, the lenticular sheet 3 is transported to a transport path 12 from a supply opening 11. In the transport path 12, the lenticular sheet 3 with the lens 4 being the bottom face is transported along the arrangement direction of the lens 4. As the transportation of the lenticular sheet 3 to the transport path 12, the lenticular sheet 3 may be automatically transported by a feeding mechanism from a cassette where the lenticular sheets are stacked, or may be inserted manually into the supply opening 11. Note that in FIG. 1, the lens 4 is illustrated with being magnified in size.

In the transport path 12, there is a feeding roller pair 15 near the supply opening 11. The feeding roller pair 15 consists of a capstan roller 15*a* and a pinch roller 15*b*. The capstan roller 15*a* is driven by a motor 16, and the pinch roller 15*b* is rotated following the transportation of the lenticular sheet 3. The pinch roller 15*b* moves between a nip position and a release position. At the nip position, the pinch roller 15*a* and the capstan roller 15*b* nip the lenticular sheet 3. At the release position, the pinch roller 15*a* retreats from the lenticular sheet 3.

When the feeding roller pair 15 nips the lenticular sheet 3 in the transport path 12 and the motor 16 drives the capstan roller, the lenticular sheet 3 is transported downstream (left side in FIG. 1) along the transport path 12. When the leading end of the lenticular sheet 3 reaches a clamp unit 17 and the clamp unit 17 clamps the lenticular sheet 3, the pinch roller 15*b* moves to the release position to release the nip of the lenticular sheet 3.

As mentioned below, while the oblique transportation of the lenticular sheet 3 is detected and corrected, the feeding roller pair 15 may hold nipping of the lenticular sheet 3 to give an appropriate tension to the lenticular sheet 3. In this case, it is preferable that nipping force of the feeding roller pair 15 is weaken so that the lenticular sheet 3 can slide on the rollers 15*a* and 15*b* when the oblique transportation is corrected.

The clamp unit 17 comprises a clamper 18 (illustrated in FIG. 4) to clamp the leading edge of the lenticular sheet 3 to be transported, a switching mechanism for opening and closing the clamper 18, a rotation mechanism 19 (illustrated in FIG. 4) which rotates the clamper 18 to correct an oblique transportation of the lenticular sheet 3, and so on.

A transport mechanism 20 reciprocates the clamper 18 horizontally along the transport path 12. Accordingly, the lenticular sheet 3 whose leading edge is clamped by the clamper 18 is transported in the transport path 12. The moving direction of the clamper 18 by the transport mechanism 20 is the sub-scanning direction.

When the clamper 18 is moved upstream along the transport path 12, the lenticular sheet 3 is guided into a return path 12*a* which extends obliquely downward from the upstream side of a thermal head 22 (described later). After recording, the lenticular sheet 3 is transported into the return path 12*a*, and is discharged through a discharge opening (not illustrated) by opening (releasing) movement of the clamper 18. Accordingly, to be definite, the lenticular sheet is horizontally transported in the downstream side from a thermal head 22 while recording.

In the upstream side from the clamp unit 17, the thermal head 22 is provided above the transport path 12. In addition, a rotatable platen roller 23 faces the thermal head 22 across the transport path 12.

At the lower part of thermal head 22, a heater element array 22*a* is formed. The heater element array 22*a* has a multitude of heater elements which are arranged in two lines extended in the main-scanning direction (the direction perpendicular to the sub-scanning direction). Due to use of the heater element array 22*a* having the heater elements arranged in two lines, two lines extended in the main-scanning direction can be recorded simultaneously. According to the transportation of the lenticular sheet 3, a row of lines is recorded in the sub-scanning direction.

The length of each line of the heater element array 22*a* is slightly longer than the width (the main-scanning direction) of a recording area of the lenticular sheet 3. In addition, one pixel, which is recorded by one heater element, has a length of about 2 μm in the sub-scanning direction. Accordingly, one heating of the heater element array 22*a* having two lines records a linear image on one of the minute areas.

The thermal head 22 moves between a pressing position and a retreat position. At the pressing position, the thermal head 22 presses the rear side of a recording film which is layered on the rear side of the lenticular sheet 3 on the platen roller 23. Then the thermal head 22 moves upward to the retreat position.

As the recording film, there are an image receptor film 25, an ink film 26, and a back film 27. These films are attached to a film turning mechanism 28. When the thermal head 22 is at the retreat position, the film turning mechanism 28 rotates to position the recording film to be used just under the thermal head 22. In recording, the thermal head 22 moves to the pressing position, so that the recording film just under the thermal head 22 is layered on the rear side of the lenticular sheet 3.

Each recording film has a length approximately equal to the length of the heater element array 22*a* in the main-scanning direction. And the long recording film is wound on a spool so that a plurality of the lenticular sheets 3 can be recorded in a single operation. In synchronism with transportation of the lenticular sheet 3, the recording film is fed from one spool and is wound on the other spool.

The image receptor film 25 is to form an image receptor layer on the rear side of the lenticular sheet 3. To the image receptor layer, colored ink from the ink film is adhered. When the thermal head 22 applies heat to the rear side of the image receptor film 25, with putting the image receptor film 25 on the rear side of the lenticular sheet 3, the transparent image receptor layer is transferred on the rear side of the lenticular sheet 3.

The ink film 26 is a known sublimation type, on which there is a plurality of sets of a yellow ink region, a magenta ink region and a cyan ink region arranged in sequential order along the longitudinal direction. Each ink region has an approximately same size as the lenticular sheet 3. After forming the image receptor layer on the lenticular sheet 3, the thermal head 22 heats the ink film 26 to sublimate the inks of yellow, magenta and cyan. The sublimated inks are adhered onto the image receptor layer. Through changing a heating value of each heater element of the thermal head 22, a density (an adhered ink amount) of each pixel recorded on the image receptor layer can be controlled.

The back film 27 is to form a back layer on the rear side of the lenticular sheet 3. When the thermal head 22 applies heat to the rear side of the back film 27, with putting the back film 27 on the rear side of the lenticular sheet 3 on which the image is recorded by the ink film 26, the white back layer is transferred on the rear side of the lenticular sheet 3.

To a data converter 31, parallax image data of two viewpoints is input. The data converter 31 converts the parallax image data of two viewpoints into image data of six viewpoints through image processing. The converted image date is sent to a head driver 32.

The head driver 32 drives the thermal head 22. In forming the back layer, the head driver 32 controls the thermal head 22 such that the heater elements concurrently generate adequate amounts of heat to transfer the back layer. In recording an image with use of the ink film 26, the head driver 32 controls the thermal head 22 based on the parallax image data of six viewpoints to record three colors in a frame sequential order.

An oblique transportation detector 33 is provided between the feeding roller pair 15 and the thermal head 22, and a lens sensor 34 is provided between the thermal head 22 and the clamp unit 17. The oblique transportation detector 33 is for optically detecting the oblique transportation of the lenticular sheet 3. The oblique transportation detector 33 and the controller 35 constitute (work as) a rotation controller. The lens sensor 34 is for optically detecting a lens pitch and a lens position. The lens sensor 34 and the controller 35 constitute a lens detector.

Figure 3:
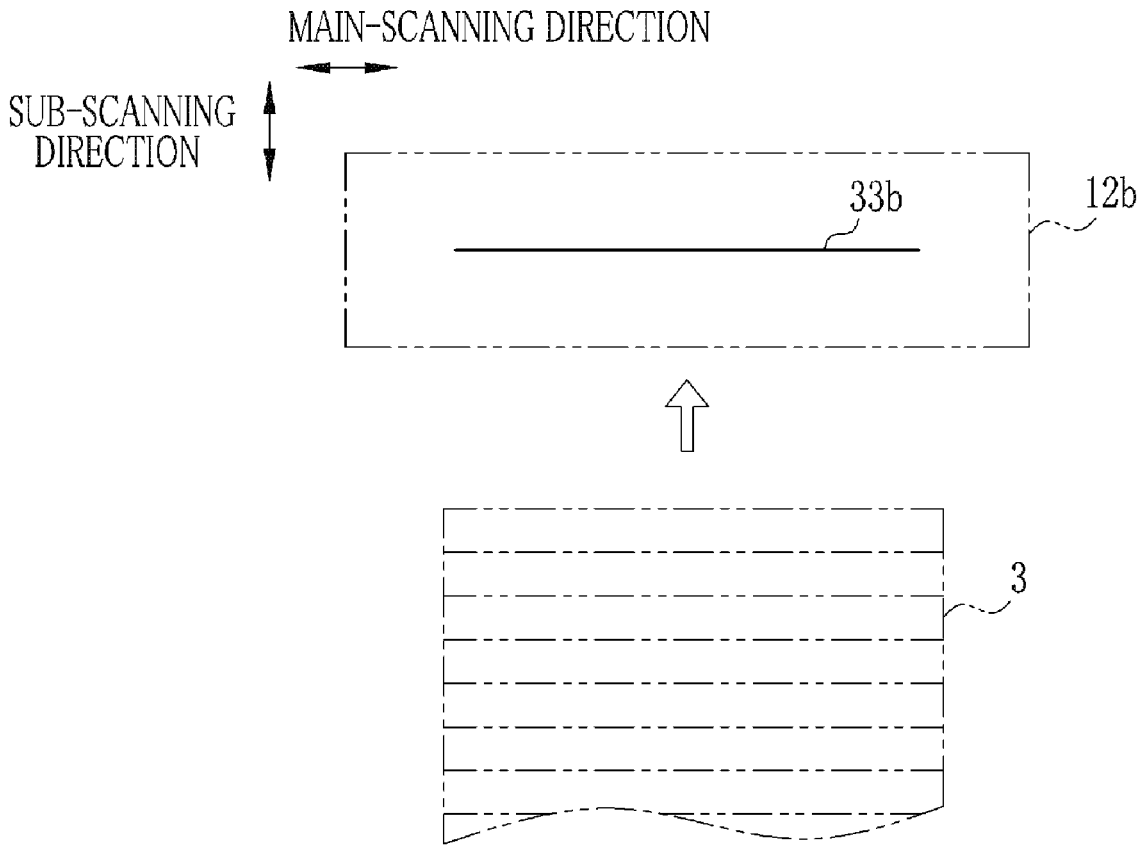
FIG. 3 is an explanatory drawing which illustrates a reference line for detecting an oblique transportation.

The oblique transportation detector 33 includes an oblique transportation sensor 33*a* provided above the transport path 12, and a reference line 33*b* drawn on an inner surface of the transport path 12. As illustrated in FIG. 3, the reference line 33*b* is for example a black straight line parallel to the main-scanning direction and is drawn on a plate 12*b* of the transport path 12 at a position facing with the oblique transportation sensor 33*a*. The width (length in the sub-scanning direction) of the reference line 33*b* is narrower than the lens width.

The oblique transportation sensor 33*a* is a two-dimensional sensor having a plurality of light receiving elements arranged in a matrix, and outputs an image signal corresponding to an image of the reference line 33*b* observed through the lenticular sheet 3. The controller 35 refers the image signal to control the rotation mechanism 19 to rotate the clamper 18 to correct the oblique transportation of the lenticular sheet 3.

As the oblique transportation sensor 33*a*, a linear sensor having a plurality of light receiving elements aligned in the main-scanning direction may be used. Note that a number of light receiving elements and an interval thereof are not limited as long as whether a striped pattern is generated or not can be detected based on the signal output from the oblique transportation sensor 33*a* (as described later).

The lens sensor 34 includes a light projector 34*a* and a light receiver 34*b*. The light projector 34*a* has a light emitting element such as a light emitting diode, and projects inspection light toward the lenticular sheet 3. The light receiver 34*b* receives the inspection light transmitted through the lenticular sheet 3, and outputs a detection signal according to intensity of the received inspection light. The controller 35 detects the lens pitch and the lens position on the lenticular sheet 3 based on the detection signal varying according to the detected position on the concave-convex surface of the lenticular sheet 3, while the lenticular sheet 3 is moved against the lens sensor 34 in the sub-scanning direction by transportation. The detected lens pitch and lens position are referred for control of record timing of the linear image.

The detection of the lens pitch by the lens sensor 34 is performed while the clamper 18 moves the lenticular sheet 3 for transportation, with the thermal head 22 being at the pressing position. Accordingly, on the lenticular sheet 3, there becomes a tension between the position where the thermal head 22 and the platen roller 23 nip and the position where the clamper 18 clamps. This contributes the detection of the lens pitch with high precision, as long as a stretch amount of the lenticular sheet 3 by the tension, a change in a stretch ratio according to environmental temperature, and other conditions are considered.

In addition, the lens pitch is detected while the lenticular sheet is transported for forming the image receptor layer. Accordingly, the time required for recording an image on the lenticular sheet 3 can be decreased. Further, since the detection is performed while the thermal head 22 heats for forming the image receptor layer, the lens pitch can be detected under conditions similar to conditions when the linear image is recorded.

The detection of the lens position is performed while the clamper 18 moves the lenticular sheet 3 for transportation with the thermal head 22 being at the pressing position, as same as the detection of the lens pitch. The lens position is detected when each of the transportations of the lenticular sheet 3 for forming the image receptor layer, recording images in each color, and forming the back layer.

Note that the configuration of the lens sensor 34 is not limited above as long as the detection signal according to the concave-convex surface (due to the lens 4) of the lenticular sheet 3 can be obtained. For example, a configuration described below may be used. The light projector 34*a* and the light receiver 34*b* are provided above the transport path 12 and a reflective plate is provided below the transport path 12, so that the inspection light from the light projector 34*a* passes through the lenticular sheet 3 and is reflected on the reflective plate, and then the reflected light passes through the lenticular sheet 3 and is received by the light receiver 34*b*. In addition, the light projector 34*a* is not required to face the light receiver 34*b*. The one can be shifted against the other in each of the main-scanning direction and the sub-scanning direction.

A controller 35 controls each part of the printer 2. The controller 35 detects the transportation length based on a direction of the transportation and the number of drive pulses fed to the motor which drives the transportation mechanism. Note that after correction of the oblique transportation of the lenticular sheet 3, a transportation position of the lenticular sheet can be determined based on the detection signal from the lens sensor 34. In addition, after the detection of the lens pitch, the transportation length of the lenticular sheet 3 can be detected. Accordingly, these methods can be used instead.

Figure 4:
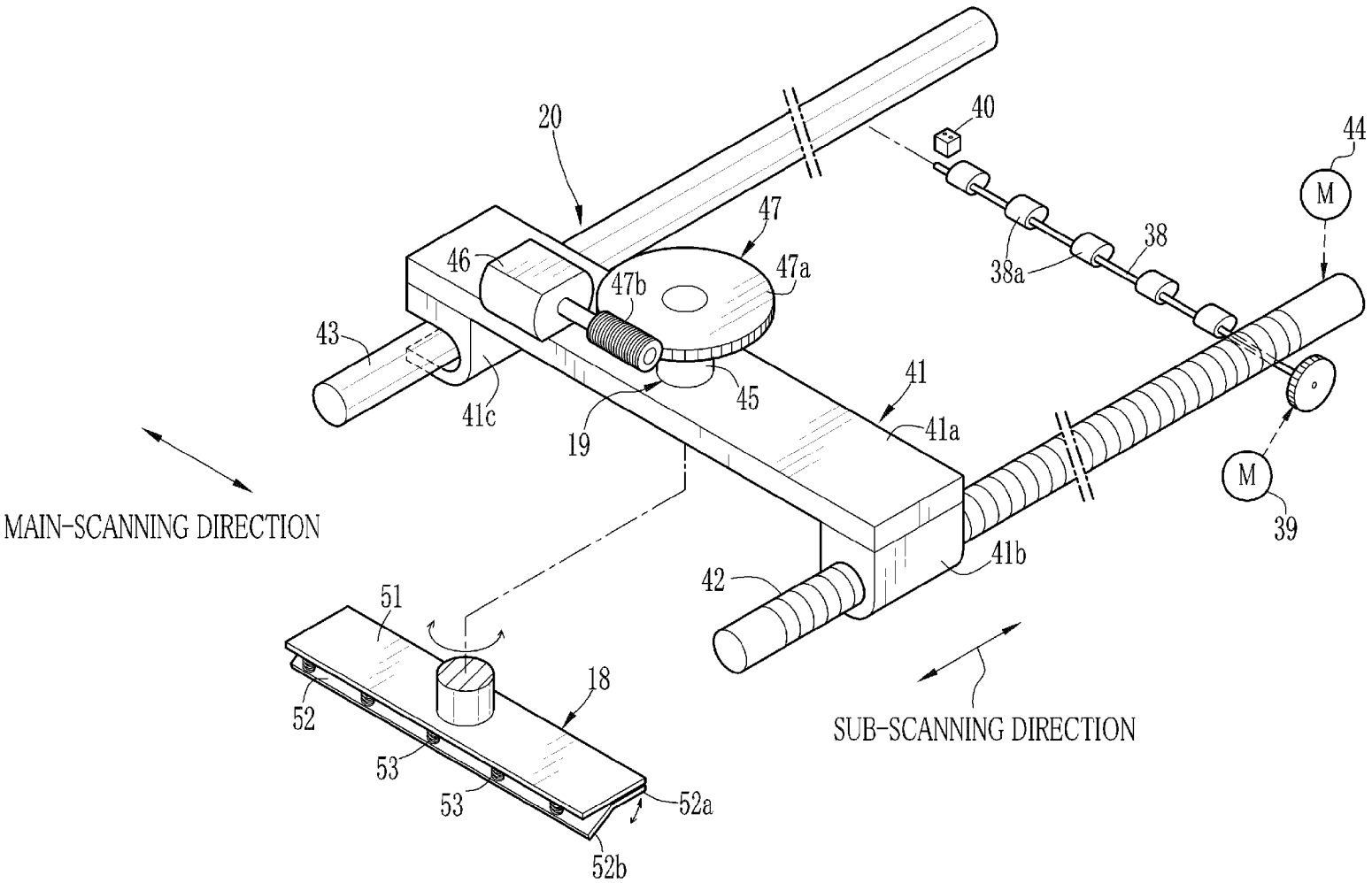
FIG. 4 is a perspective view which illustrates a clamper unit and a transportation mechanism.

FIG. 4 illustrates the clamp unit 17 and the transport mechanism 20. The clamp unit 17 comprises the clamper 18, the rotation mechanism 19, a camshaft 38, an unclamp motor 39, an edge detecting sensor 40 and so on. The transport mechanism 20 comprises a movable stage 41, a lead screw 42, a guide shaft 43, a transport motor 44 and so on.

The movable stage 41 includes a base plate 41*a* whose long side is along the main-scanning direction, and a feed member 41*b* and a guide member 41*c* which are integrally attached to both ends of the bottom surface of the base plate 41*a*. The lead screw and the guide shaft 43 extend horizontally along the sub-scanning direction, and they face across the transport path 12. The lead screw 42 passes through a screw hole provided for the feed member 41*b*, and the guide shaft 43 passes through a groove provided for the guide member 41*c*. Accordingly, the movable stage 41 is movable along the sub-scanning direction.

The transport motor 44 rotates according to drive pulses from the controller 35. The movable stage 41 is moved downstream along the transport path 12 by normal rotation of the transport motor 44, and is moved upstream along the transport path 12 by reverse rotation of the transport motor 44. The controller 35 moves the movable stage 41 downstream when forming the image receptor layer and the back layer, and recording images.

The rotation mechanism 19 comprises a rotation shaft 45, a motor 46, and a worm gear 47. The rotation shaft 45 is provided at the center of the base plate 41*a*, and is rotatable around the vertical axis. To the upper side of the rotation shaft 45, and a worm wheel 47*a* of the worm gear 47 is fixed. A worm 47*b* fixed to the output shaft of the motor 46 is engaged with the worm wheel 47*a*.

The rotation shaft 45 penetrates the base plate 41*a*, and the clamper 18 is attached to the lower end of the rotation shaft 45. Accordingly, the clamper 18 is rotatable on the transportation surface of the lenticular sheet 3 which is horizontal. When the controller 35 drives the motor 46, the clamper 18 and the lenticular sheet 3 clamped by the clamper 18 is rotated on the transportation surface so that the oblique transportation of the lenticular sheet 3 is corrected. As described above, the simple mechanism which rotates the clamper 18 makes correction of the oblique transportation of the lenticular sheet 3.

Note that as the rotation mechanism 19, any other configuration can be adopted if it can rotate the lenticular sheet 3 through rotation of the clamper 18.

The clamper 18 includes a stationary plate 51, a movable plate 52 and a spring 53. The stationary plate 51 is a flat plate whose length in the main-scanning direction is approximately equal to the width of the lenticular sheet 3. The rotation shaft is attached to the center of the upper surface of the stationary plate 51. The stationary plate 51 is parallel to the transportation surface.

The movable plate 52 has the length equal to that of the stationary plate 51 in the main-scanning direction, and is bent down in the sub-scanning direction. The movable plate 52 is swingably attached to the lower surface of the stationary plate 51 through a shaft 54 (see FIG. 5) positioned along the bent edge portion of the movable plate 52, and swings between a release position where an upstream side edge portion 52*a* is apart from the stationary plate 51 and a clamp position where the upstream side edge portion 52*a* is close to the stationary plate 51. A spring 53 is provided between the stationary plate 51 and a downstream side edge portion 52*b* to apply a bias force for moving the movable plate 52 toward the clamp position.

The clamper 18 integrally moves with the movable stage 41 between a working position and an end position downstream from the working position. In the working position, the movable plate 52 is moved between the clamp position and the release position. Through the movement between the working position and the end position, the lenticular sheet 3 clamped by the clamper 18 is transported.

At the working position, there is a camshaft 38 for rotating the movable plate 52. A cam 38*a* provided with the camshaft 38 contacts the lower surface of the downstream side edge portion 52*b* when the clamper 18 is at the working position. When the camshaft 38 is rotated by the unclamp motor 39 while the clamper 18 is at the working position, the movable plate 52 is moved to the release position since the downstream side edge portion 52*b* is pushed up against the bias force of the spring 53 (illustrated in FIG. 5). When the cam 38*b* is further rotated as illustrated in FIG. 6, the bias force of the spring 53 moves the movable plate 52 to the clamp position.

Figure 5:
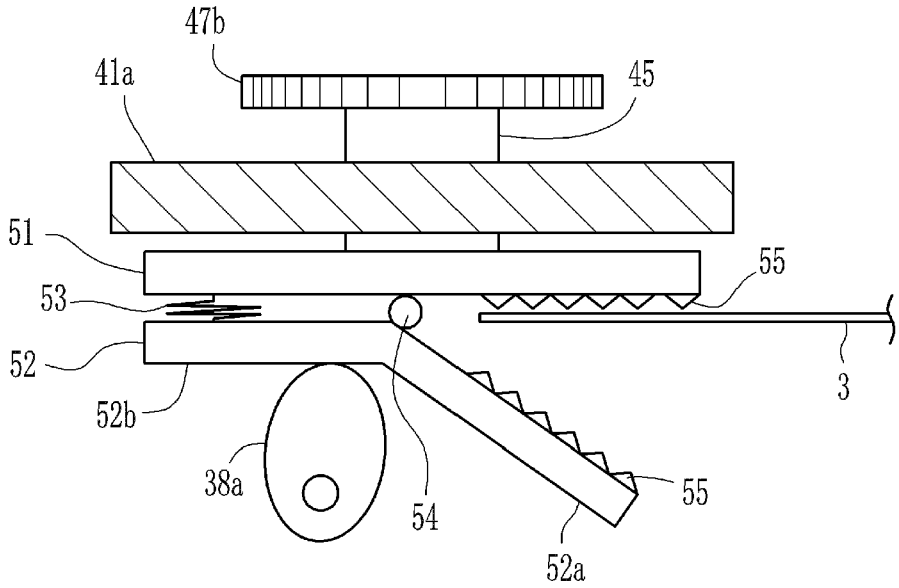
FIG. 5 is an explanatory drawing which illustrates the clamper when a movable plate is at a release position.
Figure 6:
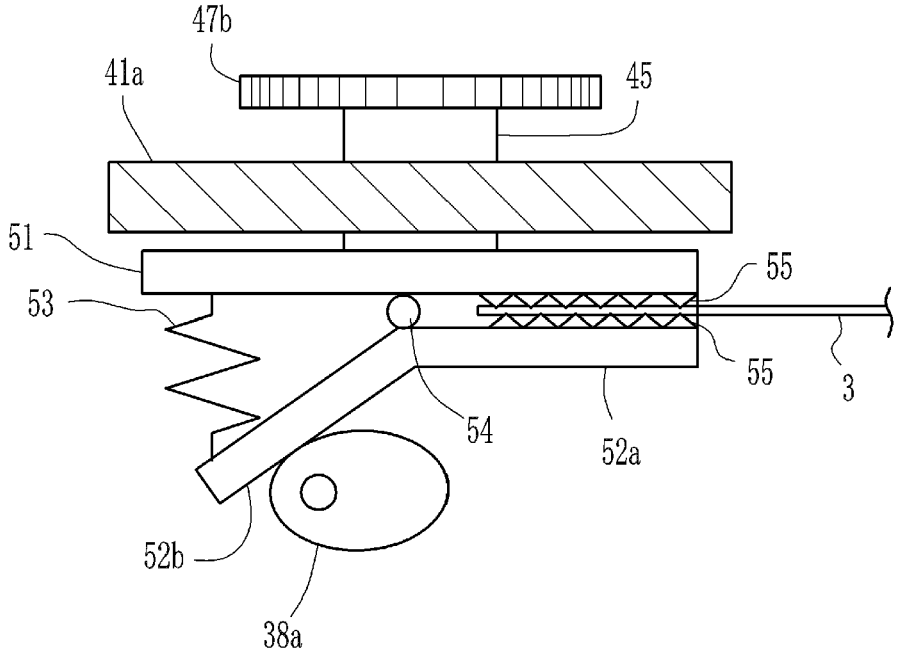
FIG. 6 is an explanatory drawing which illustrates the clamper when the movable plate is at a clamp position.

Note that a member 55 illustrated in FIGS. 5 and 6 is an anti-slip member for preventing a slip of the lenticular sheet 3 while being clamped.

In the above embodiment, the switching mechanism of the clamper 18 moves the movable plate 52 between the clamp position and the release position with use of the spring 53, the camshaft 38 and the unclamp motor 39. However, configurations of the clamper 18 and the switching mechanism are not limited to this embodiment. For example, the clamper 18 may be switched such that the fixed member contacts and pushes up the movable plate 52 toward the release position against the bias force of the spring 53 when the clamper 18 reaches the working position, and the contact between the fixed member and the clamper 18 is released and the clamper 18 switches to the clamp position when the clamper 18 slightly moves downstream from the working position. Also, a motor or another may directly switches the clamper 18 between the clamp position and the release position.

The edge detecting sensor 40 is provided to control clamp timing of the clamper 18. In feeding, the controller 35 moves the clamper 18 to the working position, and rotates the camshaft 38 when a transportation length of the lenticular sheet 3 reaches a predetermined length after the edge detecting sensor 40 detects the leading edge of the lenticular sheet 3. Since the camshaft 38 rotates, the movable plate 52 switches to the clamp position from the release position so that the clamper 18 clamps the leading edge of the lenticular sheet 3. In this case, the transportation length can be detected for example based on the drive pulses for the motor 16.

Figure 7:
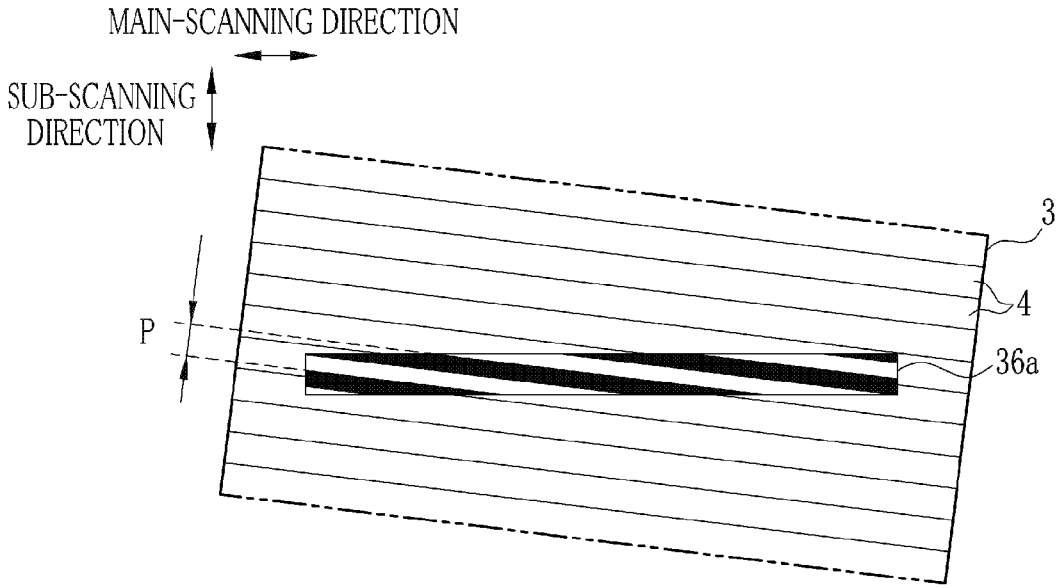
FIG. 7 is an explanatory drawing which illustrates a striped pattern observed when the lenticular sheet is obliquely transported.
Figure 8:
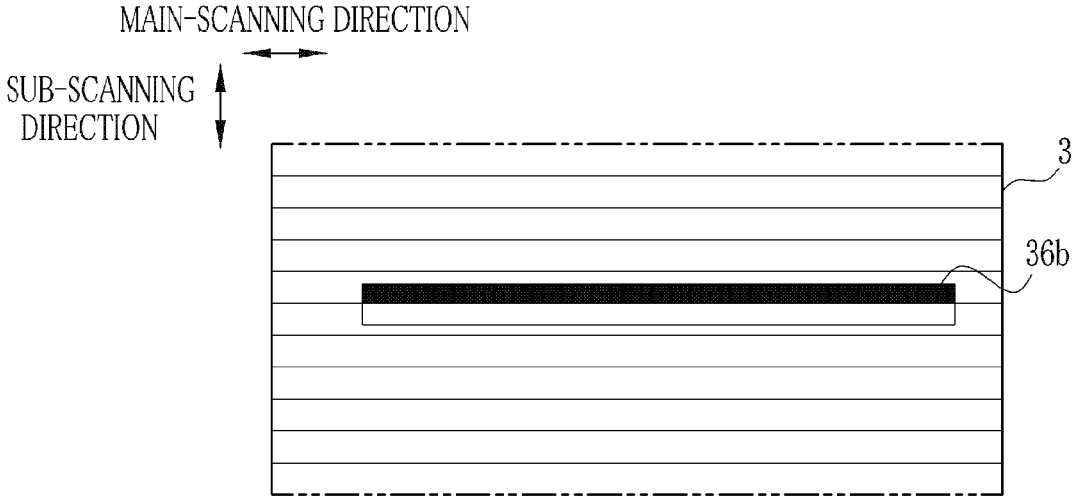
FIG. 8 is an explanatory drawing which illustrates an image observed when the oblique transportation of the lenticular sheet is corrected.

As illustrated in FIG. 7, in case that the longitudinal direction of the lens 4 is not parallel to the main-scanning direction (the lenticular sheet 3 is obliquely transported), the striped pattern 36*a* according to the lens pitch is appeared by an effect of the each lens 4 when the reference line 33*b* is observed through the lenticular sheet 3. As illustrated in FIG. 8, in case that there is no oblique transportation of the lenticular sheet 3, through the lenticular sheet 3 the reference line 33*b* is observed as an image 36*b* which has no striped pattern (there is no density modulation in the main-scanning direction).

The controller 35 actuates the rotation mechanism 19 with monitoring the image signal from the oblique transportation sensor 33*a*, so that the clamper 18 is rotated to a rotational position where the reference line 33*b* is observed as the image 36*b* as illustrated in FIG. 8 through the lenticular sheet 3. Accordingly, the oblique transportation of the lenticular sheet 3 is corrected. The correction of the oblique transportation is performed with the thermal head 22 being at the retreat position, before the detection of the lens pitch and the lens position.

Figure 9:
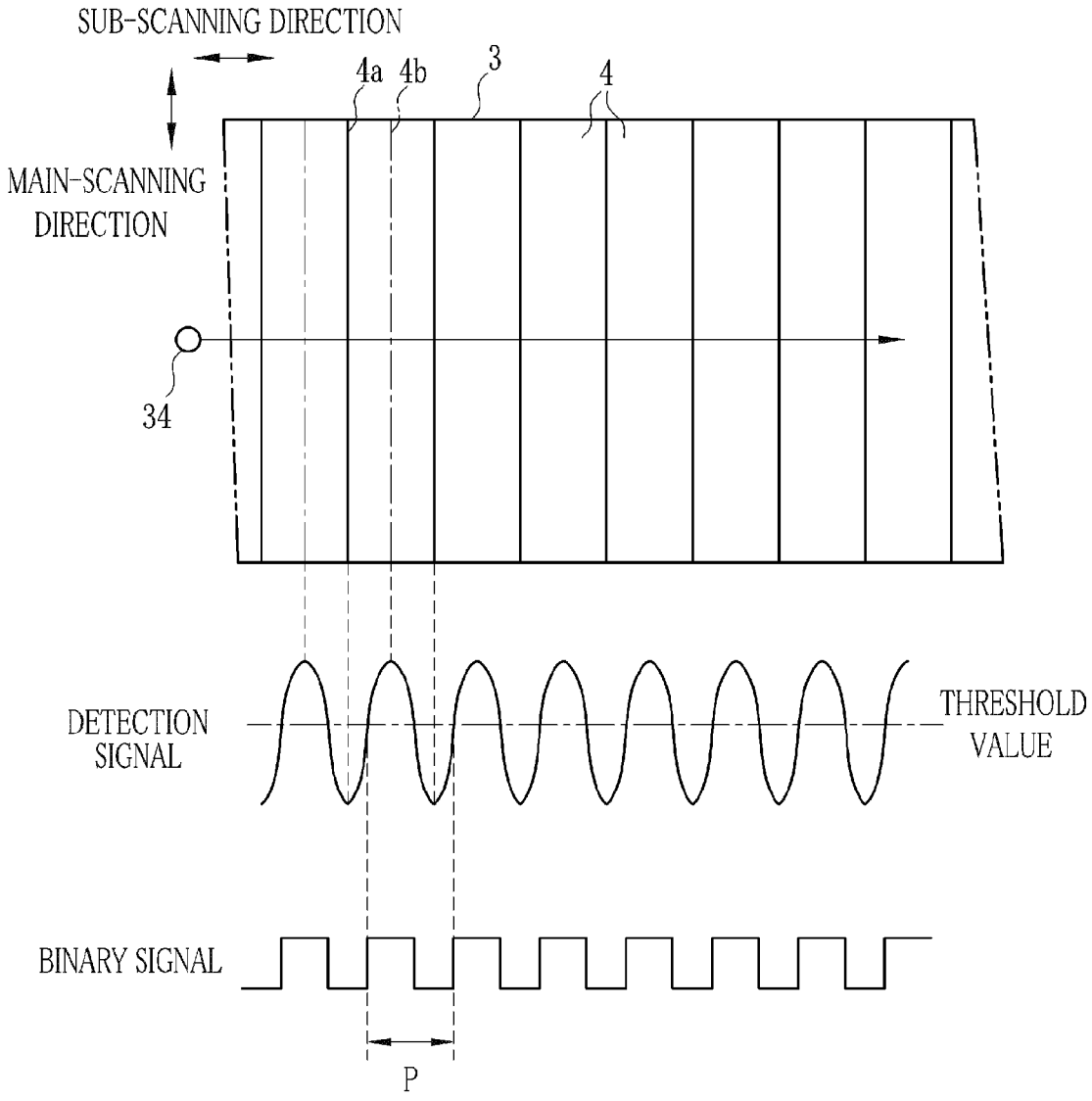
FIG. 9 is an explanatory drawing which illustrates a relation between a detection signal and a position of a lens sensor against the lenticular sheet.

According to a positional relationship between the lens sensor 34 and the lens 4, an amount of the inspection light received by the light receiver 34*b* varies, and the detection signal varies according to the amount of the received inspection light. As illustrated in FIG. 9, when the lenticular sheet 3 is moved in the sub-scanning direction against the lens sensor 34 by transportation, the detection signal is periodically varies as described below. The detection signal gradually increases when the lens sensor 34 moves from a position facing a boundary 4*a* of the lenses 4 to a position facing the vertex 4*b* of the lens 4. When the lens sensor 34 faces the vertex 4*b*, the detection signal reaches a peak. Then the detection signal gradually decreases until the lens sensor 34 faces the boundary 4*a*. After the lens sensor 34 passed the boundary 4*a*, the detection signal gradually increases again.

The controller 35 calculates a binary signal which is made by classifying the varying detection signal into two values by a predetermined threshold value. Then the transportation length of the lenticular sheet 3 transported while one cycle of the binary signal (for example rise point to rise point of the binary signal) is determined as the lens pitch P of the lenticular sheet 3. To calculate the lens pitch P, an average of the transportation lengths of the lenticular sheet while plural cycles of the binary signal is preferably used for increasing accuracy of the calculation (this method is applied to this embodiment).

Next, an operation of the above embodiment will be described. Parallax image data of two viewpoints of an image which will be recorded is input and converted into parallax image data of six viewpoints. The converted parallax image data is sequentially sent to the head driver 32.

When command to start print is given, it is confirmed that the thermal head 22 is at the retreat position. In addition, after the clamper 18 is adjusted to be approximately parallel to the main-scanning direction based on a detection result of an encoder (not illustrated) or the like, the transport mechanism 20 is actuated to move the clamper 18 to the working position. After the clamper 18 reaches the working position, the unclamp motor 39 rotates the camshaft 38. Accordingly, the movable plate 52 is moved to the release position since the downstream side edge portion 52*b* is pushed up by the cam 38*a* against the bias force of the spring 53.

After the movable plate 52 reaches the release position, one of the lenticular sheets 3 is fed into the transport path 12 from the supply opening 11. The fed lenticular sheet 3 is transported downstream in the transport path 12 by the feeding roller pair 15. In this transportation, the lenticular sheet 3 passes between the platen roller 23 and the thermal head 22 being at the retreat position, and between the light projector 34*a* and the light receiver 34*b*. Then the leading edge of the lenticular sheet 3 reaches the clamp unit 17.

When the edge detecting sensor 40 detects the leading edge of the lenticular sheet 3, the controller 35 controls the feeding roller pair 15 to further transport the lenticular sheet 3 the predetermined length so that the leading edge of the lenticular sheet 3 enters between the stationary plate 51 and the movable plate 52. After that, the transportation is stopped.

Figure 10:
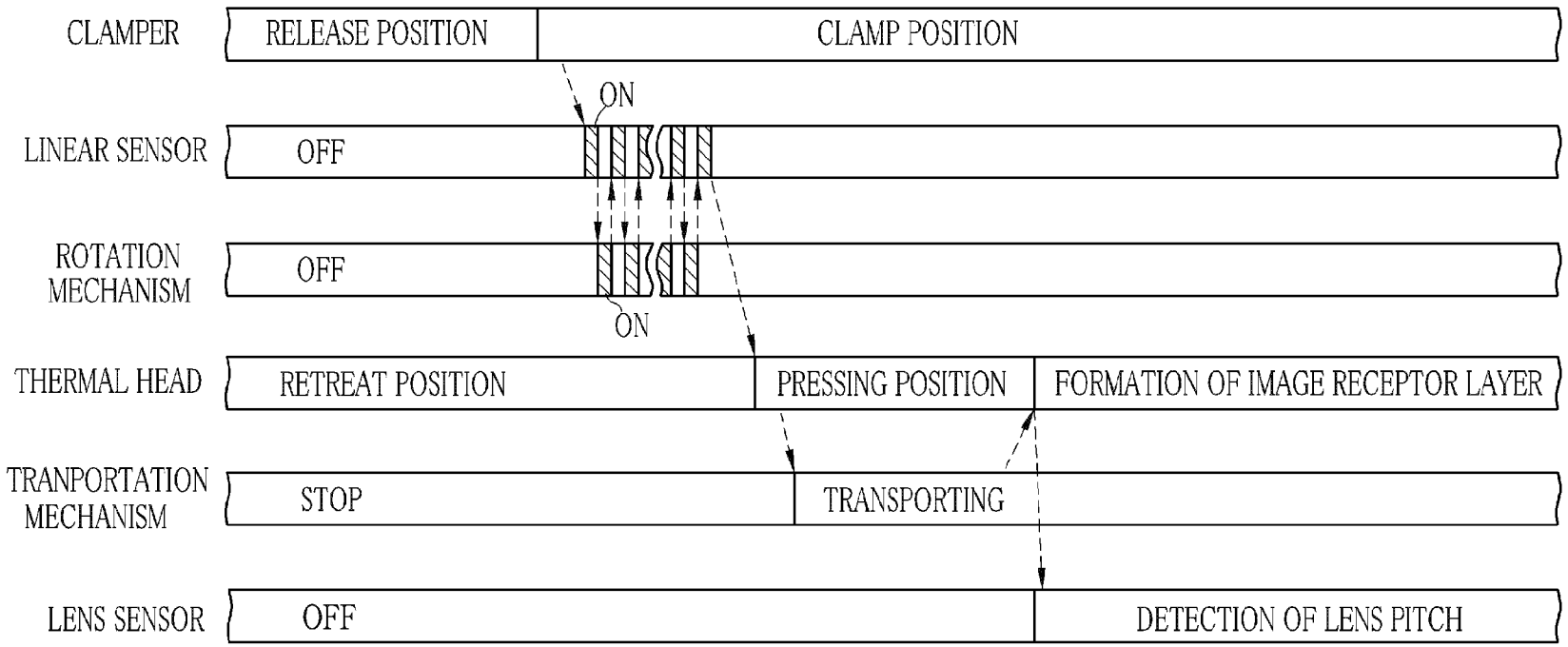
FIG. 10 is an explanatory drawing which illustrates operation timing of each section.

After the transportation is stopped, the unclamp motor 39 rotates the camshaft 38 again so that the movable plate 52 turns to the clamp position since the downstream side edge portion 52*b* is pushed down by the bias force of the spring 53 (as illustrated in FIG. 10). Accordingly, the leading edge of the lenticular sheet 3 is clamped between the stationary plate 51 and the movable plate 52. After that, the feeding roller pair 15 releases the nipping of the lenticular sheet 3.

Next, the controller 35 refers the image signal from the oblique transportation sensor 33*a*, and judges whether there is the striped pattern 36*a* as illustrated in FIG. 7 or not. If there is the striped pattern 36*a*, the controller 35 activates the rotation mechanism 19 to rotate the clamper 18 a minute angle in one direction. Since the clamper 18 clamps the edge of the lenticular sheet 3, the lenticular sheet 3 is rotated a minute angle on a horizontal plane according to the rotation of the clamper 18.

After that, the image signal is referred again to judge whether there is the striped pattern 36*a* or not. If there still is the striped pattern 36*a*, the rotation mechanism 19 is actuated again to rotate the clamper 18 a minute angle in the same direction. In this way, reference of the image signal and rotation of the clamper 18 a minute angle in one direction are repeated until the striped pattern 36*a* disappears. If the striped pattern 36*a* does not disappear though the clamper 18 is rotated a certain angle in one direction, once the clamper 18 is rotated back to the initial rotational position, and then reference of the image signal and rotation of the clamper 18 a minute angle in the other direction are repeated until the striped pattern 36*a* disappears.

When the striped pattern 36*a* becomes disappeared by the above process, the clamper 18 is held at the rotational position where the striped pattern 36*a* disappears. Accordingly, the oblique transportation of the lenticular sheet 3 is corrected so that the longitudinal direction of the lens 4 becomes parallel to the main-scanning direction.

After the correction of the oblique transportation of the lenticular sheet 3, the film turning mechanism 28 is activated to position the image receptor film 25 right down the thermal head 22. Then the thermal head 22 is moved to the pressing position. Accordingly, the thermal head 22 presses the rear side of the lenticular sheet 3 through the image receptor film 25.

After that, transport motor 44 rotates with the lead screw 42. By the rotation of the lead screw 42, the clamper 18 is moved integrated with the movable stage 41 downstream. Accordingly, the lenticular sheet 3 is transported in the sub-scanning direction. Also the image receptor film 25 is transported to follow the transportation of the lenticular sheet 3.

When the transportation of the lenticular sheet 3 starts, the transportation length of the lenticular sheet 3 calculated based on the number of drive pulses is monitored. After the recording area of the lenticular sheet 3 comes close to the position of the thermal head 22 and this state is detected, the controller 35 instructs the head driver 32 to form the image receptor layer.

By this instruction, the head driver 32 drives the heater element array 22*a* to heat the image receptor film 25. Accordingly, two lines of the transparent image receptor layer extended along the main-scanning direction are formed on the rear side of the lenticular sheet 3 by transcription.

After forming two lines of the image receptor layer, the transport motor 44 rotates to move the clamper 18 integrated with the movable stage 41 downstream a length corresponding to the two lines. Again the heater element array 22*a* heats the image receptor film 25 so that newly-formed two lines of the image receptor layer are arrayed next to the former-formed two lines of the image receptor layer in the sub-scanning direction. In the same way, with transporting the lenticular sheet 3 in the sub-scanning direction, lines of the image receptor layer are formed, two at a time. The image receptor layer covers all over the recording area.

Note that at this point, the lens pitch is not specified. Accordingly, an area actually an image is recorded on possibly becomes larger in the sub-scanning direction than the assumed recording area. Considering this problem, it is preferable that the area where the image receptor layer covers is larger in the sub-scanning direction than the assumed area for recording an image.

Concurrently with starting the formation of the image receptor layer, the controller 35 starts the detection of the lens pitch based on the detection signal. The detection signal entered into the controller 35 is converted into the binary signal, and a total transportation length corresponding to several cycles of the binary signal is calculated based on the number of drive pulses applied to the transport motor 44. Then an average transportation length corresponding to one cycle is calculated from the total transportation length. The calculated average transportation length is determined as the lens pitch P. Note that in the detection of the lens pitch, even if the lens sensor 34 faces the area where the image receptor layer is formed, there is no influence on the detection because the image receptor layer is transparent.

When forming of the image receptor layer which covers the recording area is finished, the thermal head 22 moves to the retreat position after transportation of the lenticular sheet 3 by the transport mechanism 20 is stopped. Then the transport motor 44 rotates reversely to move upstream the movable stage 41 with the clamper 18. Accordingly, the lenticular sheet 3 is transported upstream along the transport path 12. At that time, the trailing edge of the lenticular sheet 3 is guided to enter into the return path 12*a*. When the leading edge of the recording area of the lenticular sheet 3 reaches the position of the thermal head 22, the reverse rotation of the transport motor 44 is stopped.

After the film turning mechanism 28 moves the ink film 26 to a position just under the thermal head 22, the thermal head 22 is moved to the pressing position. At that time, the yellow ink region is on the rear side of the lenticular sheet 3. After that, by normal rotation of the transport motor 44, the lenticular sheet 3 clamped by the clamper 18 is transported downstream again.

Every time the lenticular sheet 3 is transported, which position on the lenticular sheet 3 faces the heater element array 22*a* is detected and monitored based on the transportation length of the lenticular sheet 3 from the rise point of the binary signal, a positional relationship in the sub-scanning direction between the lens sensor 34 and the lens 4 at the rise point of the binary signal, a distance between the lens sensor 34 and the heater element array of the thermal head 22, and the lens pitch P.

After it is detected that the heater element array 22*a* reaches the record start position (where the heater element array 22*a* faces the first minute area 5*a*), the controller 35 instructs the head driver 32 to start recording of a yellow image. According to this instruction, the thermal head 22 is driven to record linear images of yellow (two lines at a time), such that yellow ink sublimated from the ink film is adhered on the image receptor layer on the first minute area 5*a*.

After the first two lines of the yellow linear images are recorded in this way, the lenticular sheet 3 is transported downstream a transportation length corresponding to one sixth of the lens pitch P. Then the two lines of the heater element array 22*a* heat based on image data of the next two lines of the yellow image, so that the second two lines of the yellow linear images are recorded on the second minute area 5*b*.

In the same way, after every transportation of the lenticular sheet 3 in the length of one sixth of the lens pitch P, the two lines of the heater element array 22*a* heat based on image data of the next two lines of the yellow image, so that the linear images of yellow are sequentially recorded on each of the minute areas.

After the last lines of the yellow image are recorded, the transportation of the lenticular sheet 3 is stopped and then the thermal head 22 is moved to the retreat position. After that, the clamper 18 is moved upstream with the movable stage 41, to transport the lenticular sheet 3 upstream in the transport path 12. When the leading edge of the recording area passes the position of the thermal head 22, the transportation is stopped.

After feeding the ink film 26 so that the magenta ink region is positioned on the rear side of the lenticular sheet 3, the thermal head 22 is moved to the pressing position. Then the lenticular sheet 3 is transported as same as the case of the yellow image. While the transportation, the thermal head 22 is driven based on magenta image data to record the magenta image sequentially on the minute areas 5*a* to 5*f* of the lenticular sheet 3.

After finishing the recording of the magenta image, once the lenticular sheet 3 is transported upstream, then it is transported downstream again, through the same procedure described above. After feeding the ink film 26 so that the cyan ink region is positioned on the rear side of the lenticular sheet 3, the thermal head 22 is moved to the pressing position. Then while the lenticular sheet 3 is transported downstream, the thermal head 22 is driven based on cyan image data to sequentially record linear images of cyan.

Also in recording of the magenta and cyan images, as same as in recording of the yellow image, start timing of image recording is controlled, and linear images are recorded after every transportation of the lenticular sheet 3 in the transportation length corresponding to one sixth of the lens pitch P.

Each color of image is recorded as described above. In this recording, since the longitudinal direction of each lens 4 of the lenticular sheet 3 which is in the transportation is parallel to the main-scanning direction, and the linear image is recorded with controlling the transportation length of the lenticular sheet 3 based on the measured lens pitch P, each line is recorded by the thermal head 22 without running out from the minute area 5*a*. In addition, displacement of a recorded image from the lens 4 does not occur during the entire period of the recording process.

After recording the three-color image on the recording area, once the lenticular sheet 3 is transported upstream, then it is transported downstream again, through the same procedure described above. In addition, the back film 27 is moved to the position just under the thermal head 22 by the film turning mechanism 28, and then the thermal head 22 is moved to the pressing position. While the lenticular sheet 3 is transported downstream, the thermal head 22 is driven to form the back layer on the recording area on which the three-color image is recorded.

After forming the back layer, the thermal head 22 is moved to the retreat position, and then the clamper 18 is moved toward the working position by the transport mechanism 20, with guiding the lenticular sheet 3 into the return path 12*a*. After that, the camshaft 38 is rotated so that the cam 38*a* pushes up the downstream side edge portion 52*b* against the bias force of the spring 53, so that the movable plate 52 is moved to the release position. Accordingly, the clamp of the leading edge of the lenticular sheet 3 is released, and the lenticular sheet 3 is discharged from the discharge opening.

Figure 11:
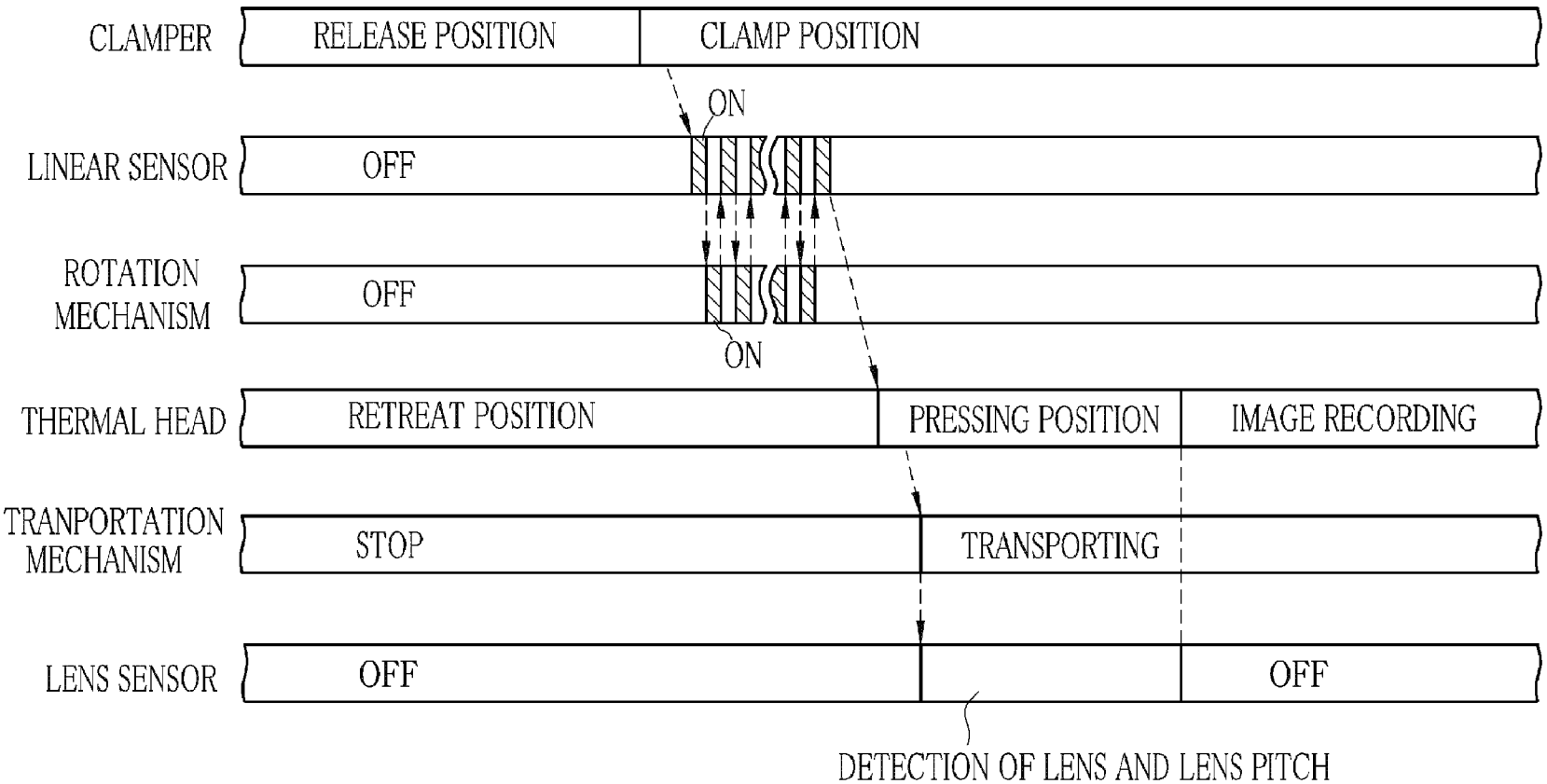
FIG. 11 is an explanatory drawing which illustrates operation timing of each section in case detection of a lens pitch is performed just before image recording.

In the first embodiment, the lens pitch is detected while the transportation for forming the image receptor layer with driving the thermal head. However, as illustrated in FIG. 11, while the lenticular sheet to record an image is transported downstream before the thermal head starts driving, that is, before the recording area reaches to the position facing the thermal head, the detection of the lens pitch may be performed. This method can be applied also to a lenticular sheet with a preformed image receptor layer.

In addition, the oblique transportation sensor may be used for detecting the lens pitch. As illustrated in FIG. 7, since an interval between the stripes (for example black lines) is corresponding to the lens pitch P, the lens pitch P can be detected by calculating the interval based on the image signal. Note that for detecting the lens pitch P, the rotation mechanism 19 may be activated so that an appropriate striped pattern is obtained.

Figure 12A:
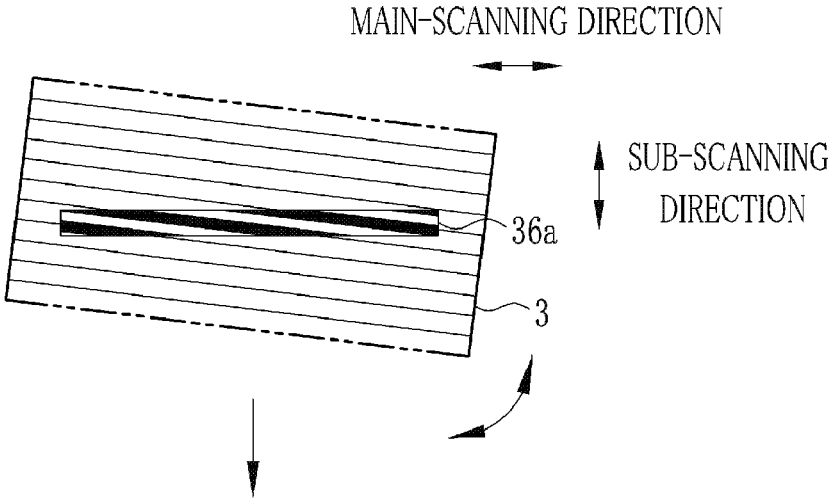
FIGS. 12A to 12C are explanatory drawings which illustrate change of an image detected by an oblique transportation sensor for detecting a lens position.
Figure 12B:
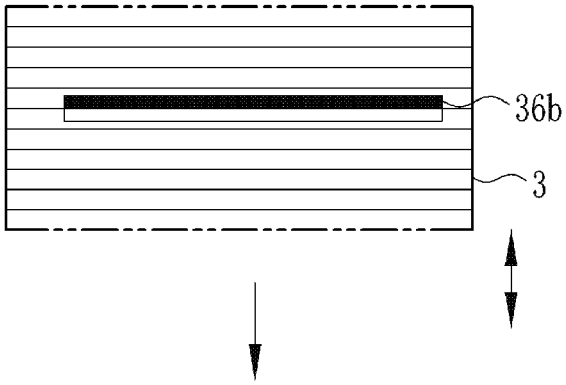
Figure 12C:
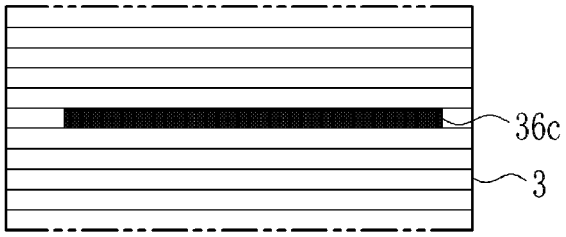

Also a method described below may be used. From a state that there is the oblique transportation of the lenticular sheet 3 and the striped pattern 36*a* is observed as illustrated in FIG. 12A, the clamper 18 is rotated based on the image signal to correct the oblique transportation of the lenticular sheet 3 so that the reference line 33*b* without changing density in the main-scanning direction is observed as illustrated in FIG. 12B. Then the transport mechanism 20 is slightly moved with reference to the image signal so that the reference line 33*b* without changing density also in the sub-scanning direction as illustrated in FIG. 12C. At that time, the center of the lens 4 coincides with the center of the reference line 33*b*.

Through the above-described process, since the lens position against the reference line 33*b* is identified, a leading edge of the recording area against the heater element array (recording start position) and so on can be identified based on the transportation length of the lenticular sheet 3 from the position where the center of the lens 4 coincides with the center of the reference line 33*b*, a distance between the reference line 33*b* and the heater element array, and the lens pitch.

Figure 13:
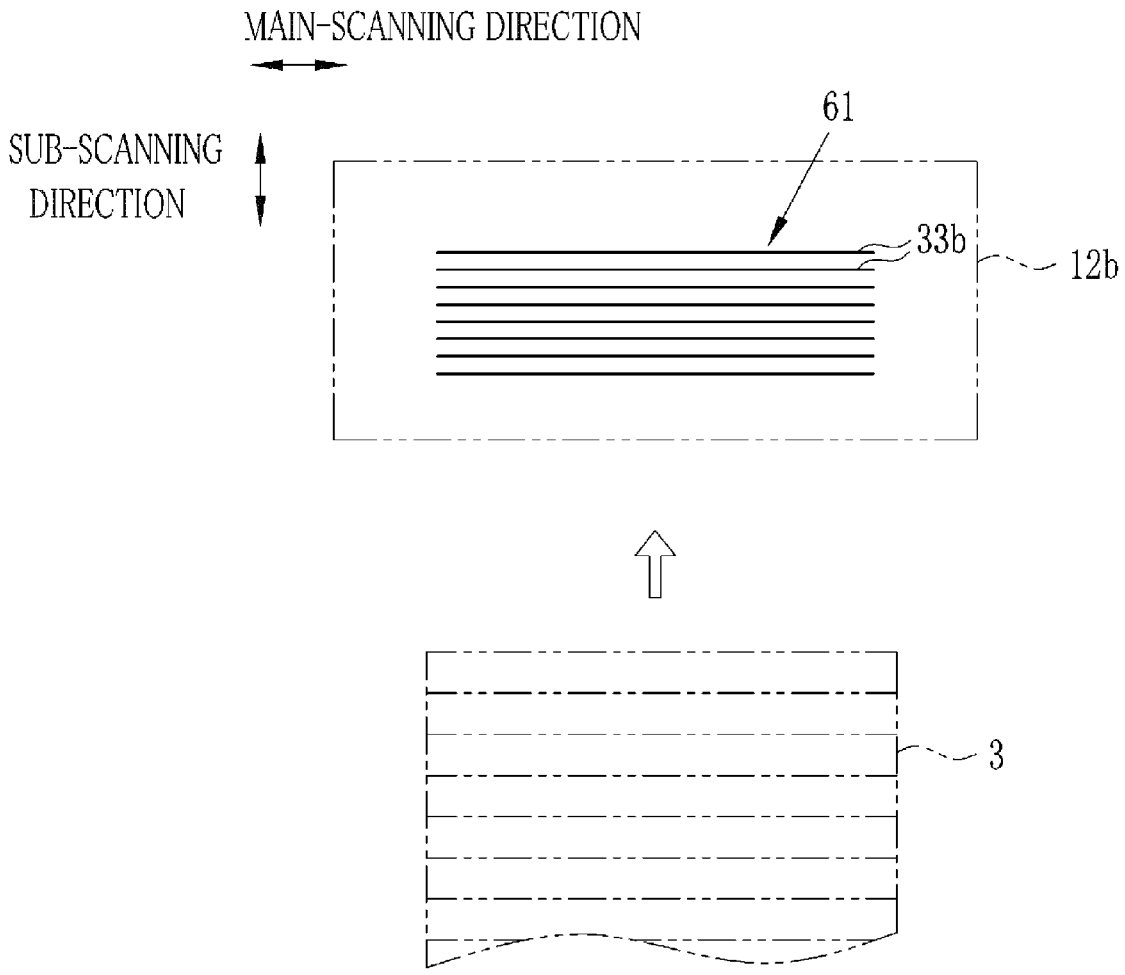
FIG. 13 is an explanatory drawing which illustrates an example in which a plurality of reference lines are provided to face the oblique transportation sensor.

In the above embodiment, one reference line is used for detecting the oblique transportation. However, a plurality of reference lines may be used for the detection. FIG. 13 illustrates an example that a reference pattern 61 including a plurality of reference lines 33*b* is prepared on a position facing to the oblique transportation sensor 33*a*. In this case, as the oblique transportation sensor 33*a*, a sensor including light receiving elements in a two-dimensional arrangement is preferably used. These reference lines 33*b* of the reference pattern 61 are arranged in the sub-scanning direction and parallel to the main-scanning direction. The width and pitch of the reference lines 33*b* are not exceeding the lens width.

Figure 14A:
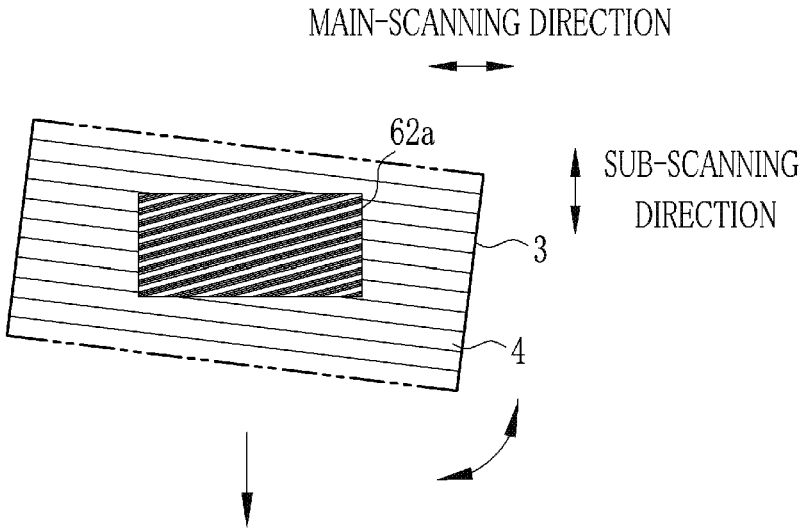
FIGS. 14A to 14C are explanatory drawings which illustrate change of an image from correction of the oblique transportation to identification of the lens position in case there are the plural reference lines.
Figure 14B:
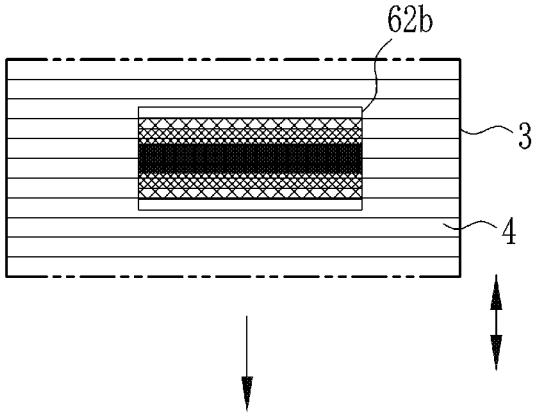

In case the reference pattern 61 is used, when the lenticular sheet 3 is obliquely transported, as illustrated in FIG. 14A, the reference pattern 61 is observed with a moire pattern 62*a* through the lenticular sheet 3, and this is detected by the oblique transportation sensor. To correct the oblique transportation of the lenticular sheet 3, as illustrated in FIG. 14B, a rotational position of the clamper 18 is controlled so that the moire 62*a* is disappeared and an image 62*b* without changing density in the main-scanning direction is detected.

Figure 14C:
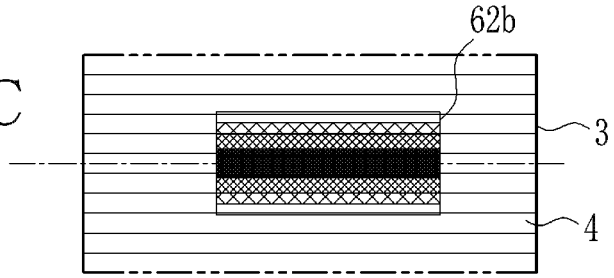

After that, when the lenticular sheet 3 is slightly moved in the sub-scanning direction by the transport mechanism 20 so that the center of the image 62*b* (corresponding to the reference pattern) in the sub-scanning direction has the highest density (as illustrated in FIG. 14C), the center of the image 62*b* coincides with the center of the lens. In this state, as same as the state illustrated in FIG. 12C, since the lens position against the reference line 33*b* is identified, the leading edge of the recording area against the heater element array (recording start position) and so on can be identified. In addition, by transporting the lenticular sheet 3 from this state, the transportation length corresponding to one cycle of change of density distribution of the image can be detected based on the image signal from the oblique transportation sensor 33*a*. The detected transportation length corresponds to the lens pitch.

Figure 15:
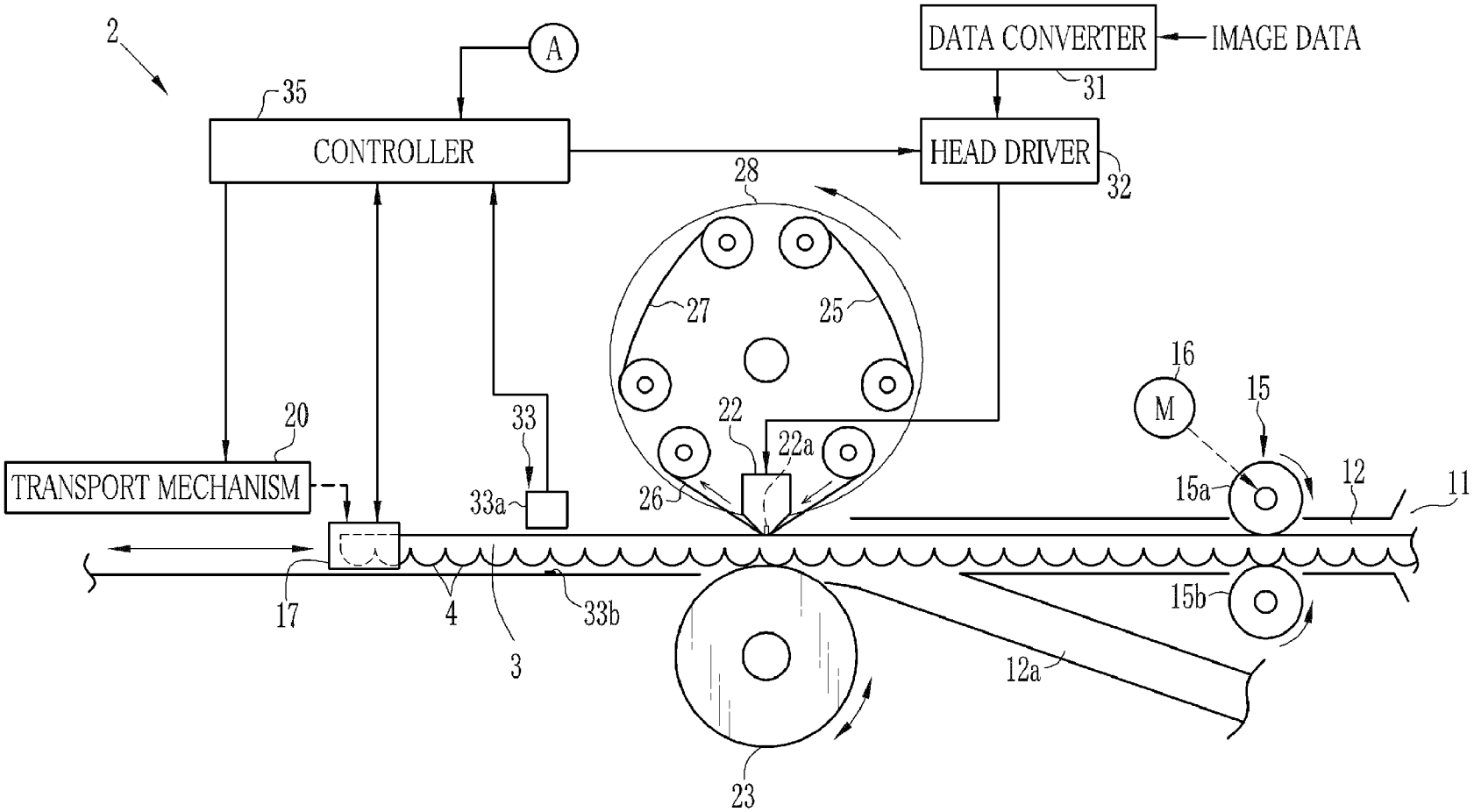
FIG. 15 is an explanatory drawing which illustrates an outline of a printer having an oblique transportation detector between a thermal head and a clamp unit.

In case the oblique transportation detector 33 is used for detection of the lens pitch and identification of the lens position as described above, in addition for correction of the oblique transportation of the lenticular sheet 3, as illustrated in FIG. 15, it is preferable that the oblique transportation detector 33 as the lens sensor is positioned between the thermal head 22 and the clamp unit 17. In this case, the movement of the clamper 18 is preferably controlled so that an appropriate tension, for example the same tension when the image receptor layer and the image are recorded, is applied on the lenticular sheet 3. Accordingly, the detection accuracy is increased since the tension between the thermal head 22 and the clamper 18, and the heating process using the thermal head 22 can be considered.

Figure 16:
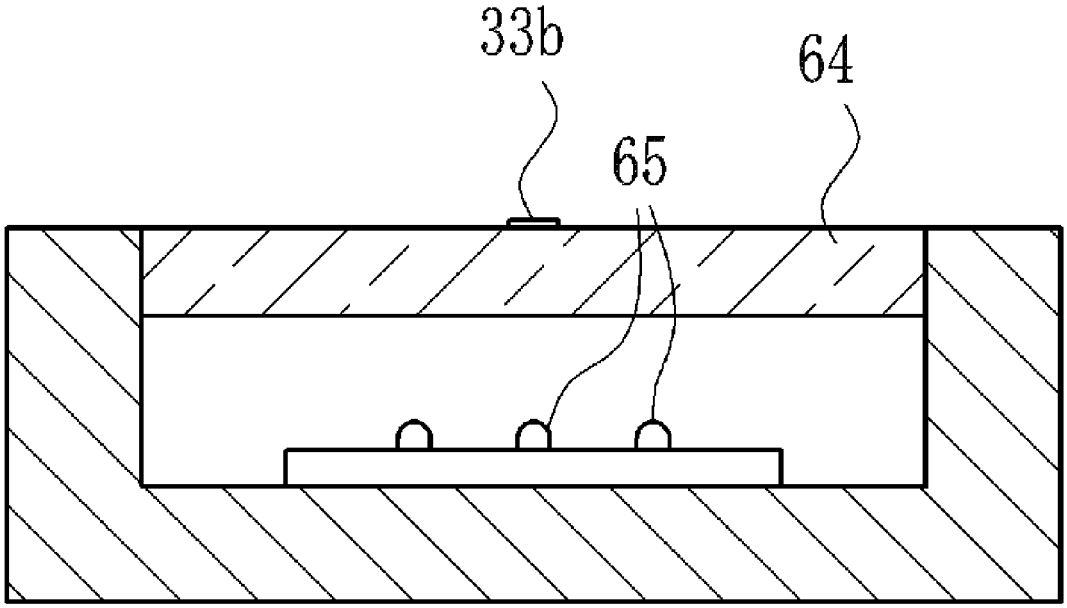
FIG. 16 is a cross-sectional view of an example in which a reference line is provided on a diffusion plate illuminated by a light source.

In the above examples, the reference line is drawn on the plate which is the part of the transportation path. However, for example as illustrated in FIG. 16, the reference line 33*b* may be drawn on an upper surface of a transparent white diffusion plate 64 and the diffusion plate 64 may be illuminated from its lower surface with use of a light source 65 such as an LED.

Second Embodiment

In a second embodiment, three lens sensors are used for detecting the oblique transportation angle of the lenticular sheet in addition to the lens pitch and the lens position. Note that since this embodiment is the same to the first embodiment except a part which is described below, the common components have same reference number and detailed explanations for the common components are omitted.

Figure 17A:
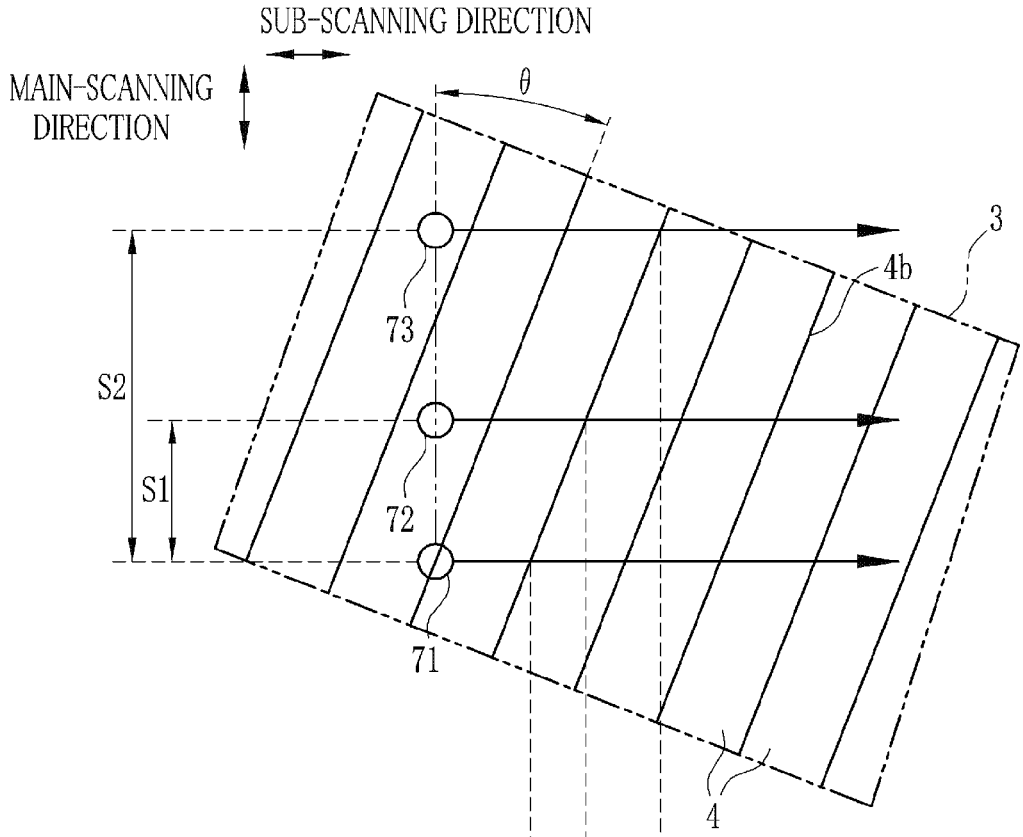
FIGS. 17A and 17B are explanatory drawings which illustrate an example in which three lens sensors are used to measure an oblique transportation angle and a lens pitch of the lenticular sheet.
Figure 17B:
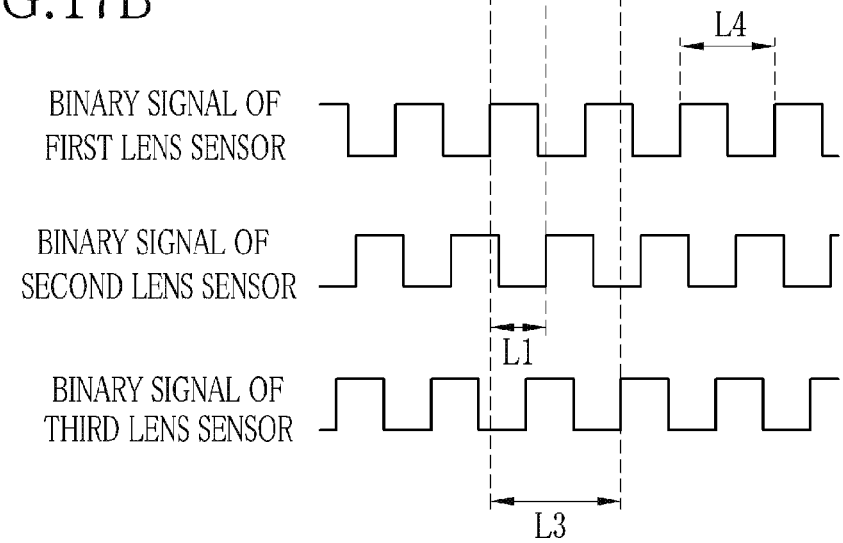

In FIGS. 17A and 17B, an arrangement of the lens sensors and a binary signal obtained from each lens sensor are illustrated. Note that to clarify a relation between the lens sensor and an intended lens for detection, the boundary 4*a* of the lens 4 is used as a specified place for explanation. Accordingly, in the illustration of FIGS. 17A and 17B, the rise point of the binary signal of the detection signal is corresponding to the boundary 4*a* of the lens 4. In practice, as the same as the first embodiment, the detection signal is divided into two values at a predetermined threshold value, and for example an intended place for detection corresponding to the rise point of the binary signal is a specified place.

In the printer 2, first to third lens sensors 71 to 73 are provided. The first to third lens sensors 71 to 73 are positioned between the thermal head 22 and the clamp unit 17, and aligned in the main-scanning direction in the order the first lens sensor 71, the second lens sensor 72, and the third lens sensor 73.

Each of the lens sensors 71 to 73 has the same construction as the lens sensor 34 in the first embodiment. In this embodiment, since the oblique transportation of the lenticular sheet 3 is corrected based on detection results from the first to third lens sensors 71 to 73, the oblique transportation detector 33 is omitted.

The oblique transportation of the lenticular sheet 3 clamped by the clamper 18 is limited to a certain degree by increasing an accuracy of positional control while the lenticular sheet 3 is transported with use of the feeding roller pair 15 and so on. A sensor interval S1 between the first lens sensor 71 and the second lens sensor 72 is determined such that a displacement length between the positions of the first and second lens sensors 71 and 72 against the lenticular sheet 3 which is fed and clamped does not reach a length equal to or more than one lens pitch. Note that the displacement length means a difference between the distance from each lens sensor to the same lens 4 (length in the sub-scanning direction).

For a sensor interval S2 between the first lens sensor 71 and the third lens sensor 73, there is no limitation such as the above-described limitation for the sensor interval S1. However, to measure the oblique transportation angle with high accuracy, the sensor interval S2 is preferably as large as possible.

The controller 35 calculates a transportation length L1 from a rise point of a binary signal corresponding to the first lens sensor 71 to a rise point of a binary signal corresponding to the second lens sensor 72 based on the number of drive pulses applied into the transport motor 44. Since the displacement length between the positions of the first and second lens sensors 71 and 72 does not reach a length equal to or more than one lens pitch, the calculated transportation length L1 is a transportation length from the point when the first lens sensor 71 detects the boundary 4*a* of the arbitrary lens 4 to the point when the second lens sensor 72 detects the same boundary 4*a*.

The controller 35 calculates a displacement length L2 between the positions of the first and third lens sensors 71 and 73 by applying the transportation length L1 and the sensor intervals S1 and S2 to a following formula 1. In addition, a reference value G is calculated by applying the length L2 and a predetermined lens pitch P0 to a following formula 2.

$$L2=S2\cdot(L1/S1) \quad \text{[Formula 1]}$$

$$G=L2/P0 \quad \text{[Formula 2]}$$

The reference value G corresponds to the number of the boundaries 4 detected by the third lens sensor 73 from the point when the first lens sensor 71 detects the boundary 4 to the point when the third lens sensor 73 detects the same boundary 4, and used for identifying the rise point of the binary signal when the third lens sensor 73 detects the same boundary 4.

The controller 35 starts counting of the number of rise points of the binary signals corresponding to the third lens sensor 73, after the rise point of the binary signal corresponding to the first lens sensor 71 is detected. When the counted number of the rise points of the binary signals corresponding to the third lens sensor 73 becomes equal to or more than the reference value G, a transportation length L3 corresponding to the counting period is calculated from the number of drive pulses applied to the transport motor 44. Then an oblique transportation angle θ (the angle of the longitudinal direction of the lens 4 from the main-scanning direction) is calculated by applying the transportation length L3 and the sensor interval S2 to a following formula 3.

$$\theta=\tan^{-1}(L3/S2) \quad \text{[Formula 3]}$$

The transportation length L3 becomes nearly equal to the displacement length L2. However, since the transportation length L3 is the actually measured value with use of the sensor interval S2 which is larger than the sensor interval S1, the transportation length L3 has higher accuracy than the displacement length L2 calculated with use of the sensor interval S1. Accordingly, the oblique transportation angle θ can be calculated with higher accuracy.

The controller 35 controls the rotation mechanism 19 to rotate the clamper 18 so that the oblique transportation angle θ is canceled. Accordingly, the oblique transportation of the lenticular sheet 3 is corrected. In addition, while the lenticular sheet 3 is obliquely transported, the lens pitch P of the lenticular sheet 3 in transportation is calculated by calculating a transportation length L4 corresponding to one cycle of the binary signal corresponding to one of the lens sensors (for example the first lens sensor 71) and multiplying the calculated length L4 by cos θ. Note that the lens position can be detected based on the detection signal from one of the lens sensors.

Figure 18:
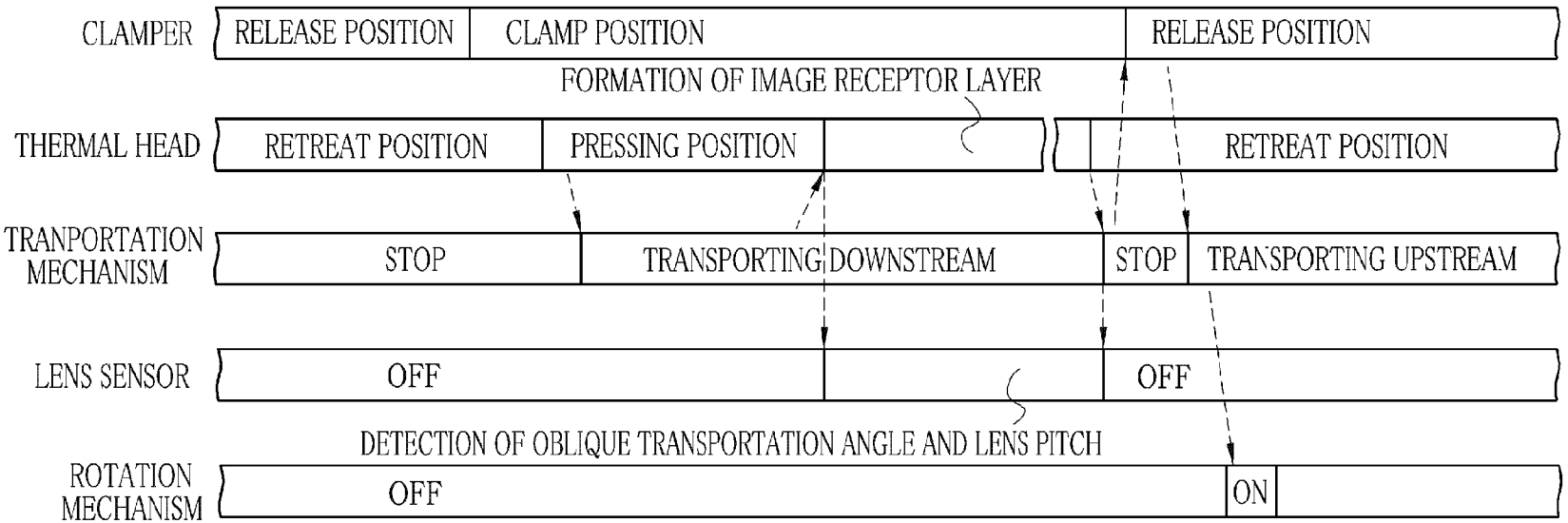
FIG. 18 is an explanatory drawing which illustrates operation timing of each section in case the three lens sensors are used.

As illustrated in FIG. 18, while the image receptor layer is formed, the detection of the oblique transportation angle θ and the lens pitch are performed based on the detection signals from the lens sensors 71 to 73. After the formation of the image receptor layer, while the lenticular sheet 3 is returned upstream with the thermal head 22 being at the retreat position, the rotation mechanism 19 is activated based on the oblique transportation angle θ to correct the oblique transportation.

Figure 19:
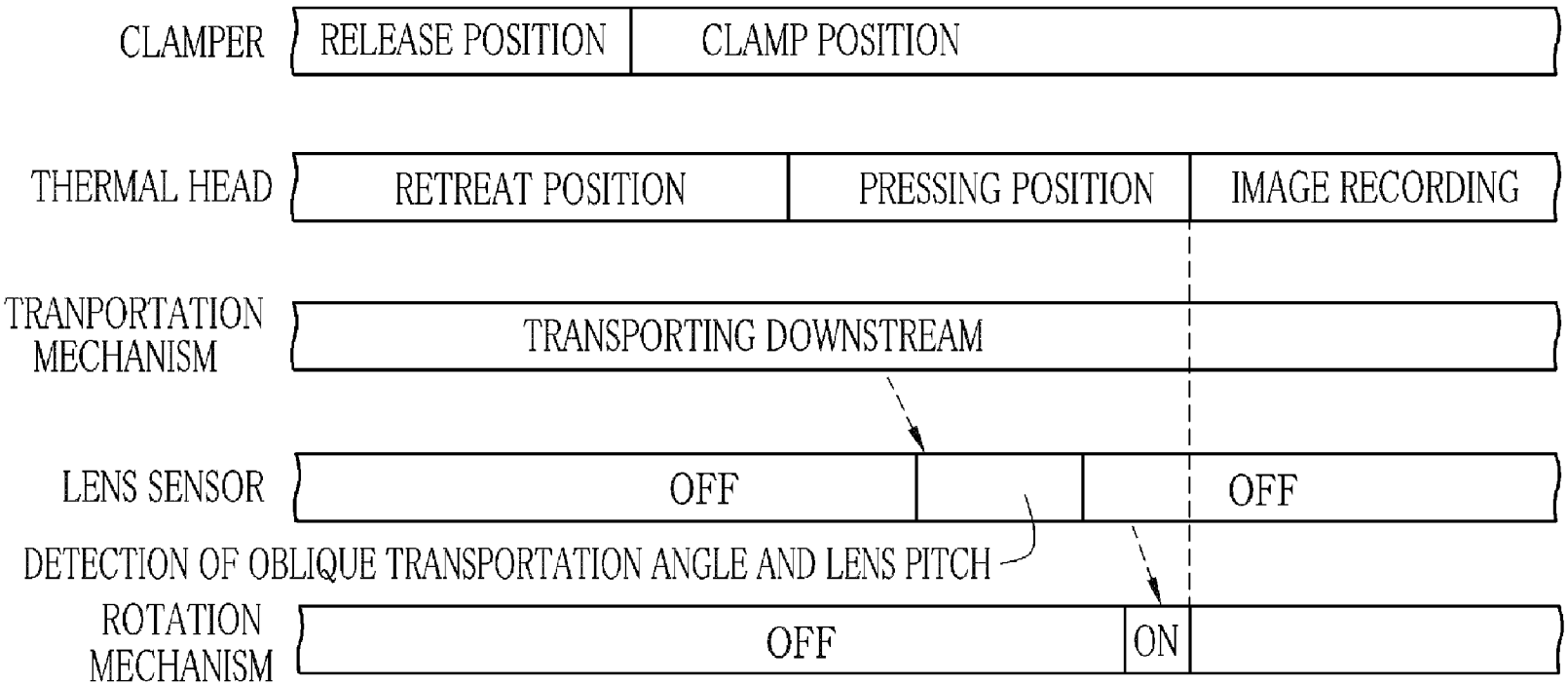
FIG. 19 is an explanatory drawing which illustrates operation timing of each section in case the three lens sensors measure the oblique transportation angle and the lens pitch of the lenticular sheet just before the image recording.

Note that as illustrated in FIG. 19, the detection of the oblique transportation angle θ and the lens pitch and the correction of the oblique transportation may be performed with use of the first to third lens sensors 71 to 73 before the thermal head 22 starts heating, while the lenticular sheet 3 is transported downstream with the thermal head 22 pressing the sheet to record the image with use of the ink film 26.

Figure 20:
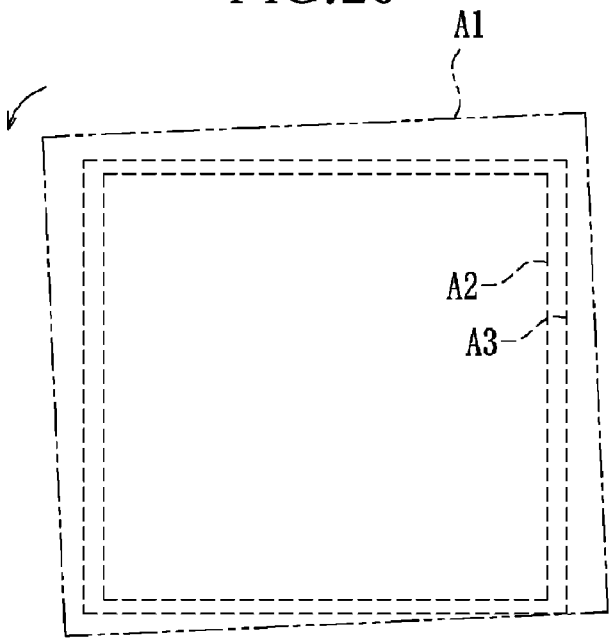
FIG. 20 is an explanatory drawing which illustrates a preferable range of an image receptor layer in case the oblique transportation is corrected after the image receptor layer is formed.

In case the oblique transportation of the lenticular sheet 3 is corrected after the formation of the image receptor layer, as illustrated in FIG. 20, it is preferable that an area A1 of the image receptor layer is larger than a recording area A2 so that the area A1 formed when the oblique transportation is not corrected still covers the recording area A2 after the oblique transportation is corrected. Note that since an area A3 of the back layer is formed after the correction of the oblique transportation, the area A3 may be equal to or slightly larger than the recording area A2.

Third Embodiment

In a third embodiment, an angle of the reference line against the thermal head is measured with use of a function of the printer and is determined as a correction angle of the oblique transportation angle, so that the longitudinal direction of the lens is adjusted to coincide with the main-scanning direction with high accuracy. Although the printer having the construction illustrated in FIG. 15 is used as an example for following explanations, this embodiment can be applied to any other printers comprising the reference line and the oblique transportation sensor having at least two light receiving elements arranged in the main-scanning direction.

Figure 21:
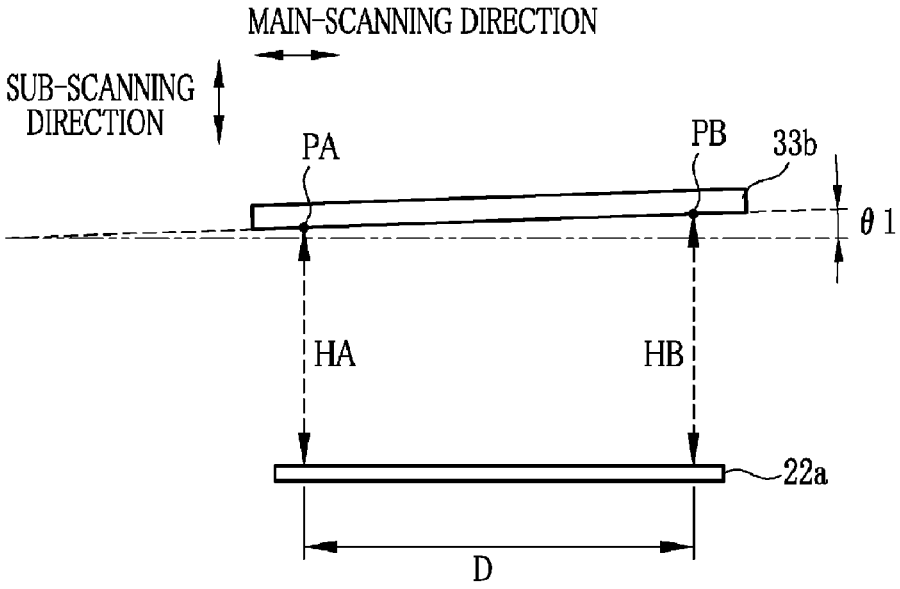
FIG. 21 is an explanatory drawing which illustrates an example in which a correction value for displacement between the reference line and the main-scanning direction is calculated.

As illustrated in FIG. 21, the angle θ1 of the reference line 33*b* against the heater element array 22*a* of the thermal head 22 measured with use of the function of the printer 2. At first, a distance HA from a point PA on the reference line 33*b* to the heater element array 22*a*, and a distance HB from a point PB on the reference line 33*b* to the heater element array 22*a* are measured. Then the angle θ1 is calculated from a following formula 4, in which the distances HA and HB and an interval D between them are applied.

$$\theta 1=\tan^{-1}\{(HB-HA)/D\} \quad \text{[Formula 4]}$$

Figure 22A:
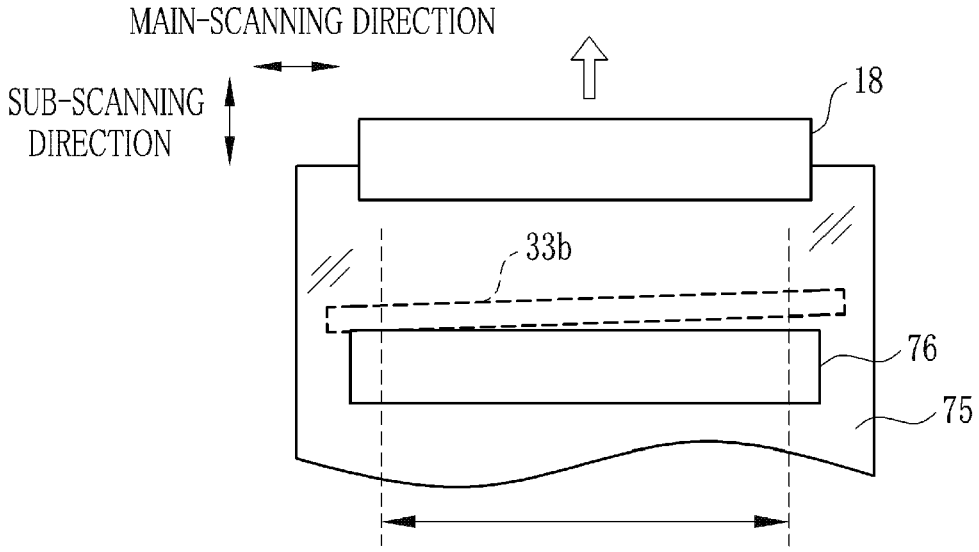
FIGS. 22A and 22B are explanatory drawings which illustrate measurement processes for calculating the correction value for displacement between the reference line and the main-scanning direction.
Figure 22B:
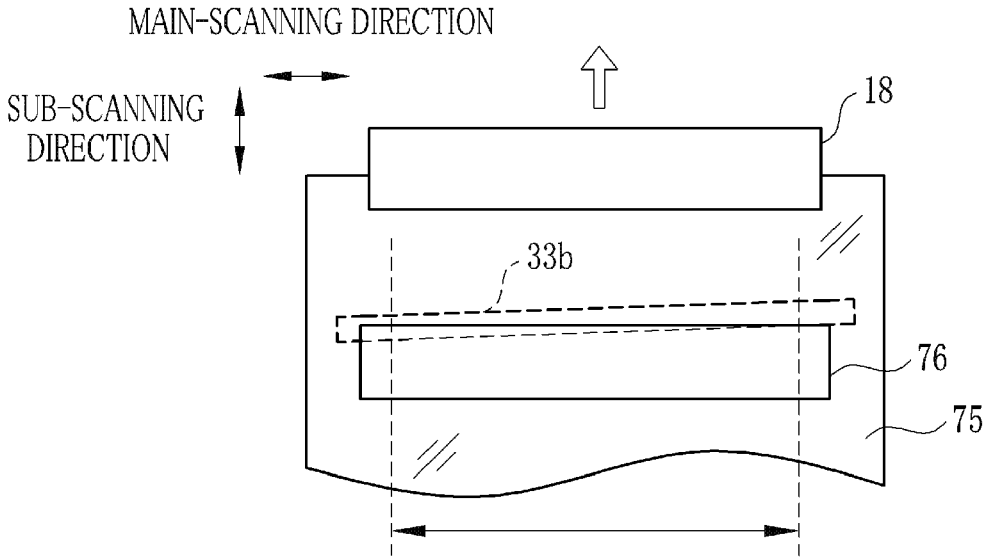

As illustrated in FIGS. 22A and 22B, for measuring the distances HA and HB, the clamper 18 clamps a transparent recording sheet 75. While the transport mechanism 20 transports the clamper 18 downstream, the thermal head 22 is driven to record a test image 76 on the recording sheet 75. The test image 76 has a constant width in the sub-scanning direction and is elongated in the main-scanning direction (the direction in which the heater element array is elongated). The test image 76 can be recorded in yellow, magenta, cyan or a combination of them with use of the ink film 26. However, in this embodiment, to reduce the cost for the recording, the test image 76 is recorded in white with use of the back film 27.

After the recording of the test image 76, the transportation is continued with the clamper 18 clamping the recording sheet 75 without rotating. And the controller 35 starts measurement of a transportation length based on the number of drive pulses for the transport motor 44, after the first line of the test image (an edge of the image in the transportation direction) is recorded.

In the transportation, as illustrated in FIG. 22A, when it is detected that the first line of the test image 76 is superimposed on the measurement position PA on the reference line 33*b*, through the image signal from the oblique transportation sensor 33*a*, the transportation length measured up to that time is obtained as the distance HA. In the same way, as illustrated in FIG. 22B, when it is detected that the first line of the test image 76 is superimposed on the measurement position PB on the reference line 33*b*, through the image signal from the oblique transportation sensor 33*a*, the transportation length measured up to that time is obtained as the distance HB.

The distances HA and HB obtained as described above and the interval D are applied to Formula 4 to calculate the angle θ1, and the angle −θ1 (opposite in sign) is stored as the correction angle in the controller 35. To correct the oblique transportation of the lenticular sheet 3, the controller 35 rotates the clamper 18 so that the striped pattern is disappeared, and then further rotates the clamper 18 the correction angle −θ1. Accordingly, the longitudinal direction of the lens 4 becomes parallel to the main-scanning direction.

The above embodiment contributes to easy manufacture and maintenance of the thermal head because high accuracy is not required in installing.

The constructions, processes and so on explained in each embodiment can be combined unless there is no contradiction. In the above embodiments, the present invention is applied to the line printer. However, the present invention can be applied to other types of printers, such as a serial printer. In addition, the present invention can be used for recording so-called a changing image (movement of a viewer or a print causes the image to flip from one image to another), in addition for recording the parallax images for making the stereo image. The present invention can be applied to a thermofusible type thermal printer, an ink-jet printer and so on in addition to the sublimation type thermal printer.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A printer comprising:

a sheet transporter which includes a clamper for clamping an edge of a lenticular sheet having a plurality of lenticular lenses and moves said clamper in a sub-scanning direction for transporting said lenticular sheet;

a recorder having a thermal head movable between a pressing position where said thermal head presses a rear side of an ink film superimposed on a rear side of said lenticular sheet and a retreat position where said thermal head is apart from the rear side of said ink film, and recording an image on the rear side of said lenticular sheet such that lines elongated in the main-scanning direction are recorded sequentially in synchronization with the transportation of said lenticular sheet, with use of said thermal head at said pressing position which heats said ink film so that ink is sublimated from said ink film and adhered on the rear side of said lenticular sheet;

a lens sensor which is positioned between said thermal head and said clamper and optically detects said lenticular sheet; and a lens detector which calculates a lens pitch on said lenticular sheet clamped by said clamper based on the detection result from said lens sensor, when said thermal head is at said pressing position.

2. A printer claimed in claim 1, wherein said lens sensor outputs detection signal according to which position on a concave-convex surface of said lenticular sheet, while said sheet transporter transports said lenticular sheet.

3. A printer claimed in claim 2, wherein said recorder forms a transparent image receptor layer on which said ink will be adhered, on the rear side of said lenticular sheet before recording said image with use of said ink film, wherein said sheet transporter transports said lenticular sheet from upstream side to downstream side from said thermal head for forming said image receptor layer, and then transports said lenticular sheet again from upstream side to downstream side from said thermal head for recording said image with use of said ink film, and wherein said lens detector calculates said lens pitch based on the detection result from said lens sensor while said lenticular sheet is transported for forming said image receptor layer.

4. A printer claimed in claim 3, further comprising:

a rotation mechanism which rotates said clamper on a transportation surface of said lenticular sheet; and a rotation controller which optically detects an inclination of said lenticular lens on said lenticular sheet clamped by said clamper from the main-scanning direction, and controls said rotation mechanism based on the detection result so that a longitudinal direction of said lenticular lens becomes parallel to the main-scanning direction.

5. A printer claimed in claim 4, wherein said lens detector detects said lens pitch after said longitudinal direction of said lenticular lens is adjusted to be parallel to the main-scanning direction by said rotation controller.

6. A printer claimed in claim 2, wherein said lens detector calculates said lens pitch based on the detection result from said lens sensor, before said thermal head reaches a recording area on which said image will be recorded by said thermal head, while said sheet transporter transports said lenticular sheet from upstream side to downstream side from said thermal head for recording said image with use of said ink film.

7. A printer claimed in claim 3, further comprising:

a rotation mechanism which rotates said clamper on a transportation surface of said lenticular sheet; and a rotation controller which optically detects an inclination of said lenticular lens on said lenticular sheet clamped by said clamper from the main-scanning direction, and controls said rotation mechanism to rotate said clamper based on the detected inclination after said image receptor layer is formed, so that the longitudinal direction of said lenticular lens becomes parallel to the main-scanning direction, wherein said recorder forms said image receptor layer on an area larger than a recording area on which said image will be recorded.

8. A printer claimed in claim 4, wherein said lens sensor has first to third sensors arranged in the main-scanning direction to output detection signal according to which position on a concave-convex surface of said lenticular sheet, with an interval between said first and second sensors determined such that a displacement length between detection positions of said first and second lens sensors against said lenticular sheet does not reach a length equal to or more than one lens pitch regardless of a degree of oblique transportation of said lenticular sheet, and wherein said rotation controller performs following steps of:

identifying detection signal, which represents that said third sensor detects a specific place arbitrarily selected on said lenticular lens which is previously detected by said first sensor, based on a transportation length from a point when said first sensor detects said specific place to a point when said second sensor outputs detection signal which represents that said second sensor detects said specific place, the interval between said first and second sensors, and an initial lens pitch;

calculating an oblique transportation angle of said lenticular sheet based on a transportation length from the point when said first sensor detects said specific place to a point when said third sensor outputs detection signal which represents that said third sensor detects said specific place, and an interval between said first and third sensors; and correcting the oblique transportation by rotating said clamper based on said oblique transportation angle.

9. A printer claimed in claim 8, wherein said lens detector measures the lens pitch of said lenticular sheet by measuring a transportation length corresponding to one cycle of detection signal from one of said first to third sensors and correcting said measured transportation length with use of said oblique transportation angle.

10. A printer claimed in claim 4, wherein said rotation controller has a reference line parallel to the main-scanning direction and an oblique transportation sensor facing to said reference line through said lenticular sheet for detecting an image observed through said lenticular sheet, and corrects the oblique transportation of said lenticular sheet by rotating said clamper with reference to output from said oblique transportation sensor so that a striped pattern observed as said image is disappeared.

11. A printer claimed in claim 1, further comprising:

a reference line parallel to the main-scanning direction, which faces to said lens sensor and has a width narrower than the lens pitch;

a rotation mechanism which rotates said clamper on a transportation surface of said lenticular sheet; and a rotation controller which controls said rotation mechanism based on the detection result from said lens sensor so that the longitudinal direction of said lenticular lens becomes parallel to the main-scanning direction, wherein said lens sensor detects an image of said reference line observed through said lenticular sheet, and wherein said rotation controller corrects the oblique transportation of said lenticular sheet by rotating said clamper with reference to output from said lens sensor so that a striped pattern observed as said image is disappeared.

12. A printer claimed in claim 11, wherein said lens detector detects the lens pitch based on said striped pattern detected by said lens sensor while said lenticular sheet is obliquely transported.

13. A printer claimed in claim 11, wherein said lens detector drives said sheet transporter to transport said lenticular sheet to a position where the center of said lenticular lens coincides with said reference line such that said reference line is detected as an image with constant density by said lens sensor, after the oblique transportation of said lenticular sheet is corrected by said rotation controller, so that said position is used as a reference for obtaining a positional relationship between said lenticular sheet and said thermal head.

14. A printer claimed in claim 11, further comprising:

a displacement angle detector which records a test image elongated in the main-scanning direction and having a certain width in the sub-scanning direction on a transparent recording sheet while said sheet transporter transports said recording sheet clamped by said clamper, and then detects a displacement angle between said reference line and the main-scanning direction based on a difference between a transportation length until said test image reaches a measurement point determined on said reference line and a transportation length until said test image reaches another measurement point determined on said reference line, and an interval between the two measurement points; and a memory for storing said detected displacement angle, wherein said rotation controller corrects a rotational position of said clamper with use of said displacement angle stored in said memory.

15. A printer claimed in claim 1, further comprising:

reference lines arranged in the sub-scanning direction with an interval narrower than the lens pitch and are parallel to the main-scanning direction, each of which faces to said lens sensor and has a width narrower than the lens pitch;

a rotation mechanism which rotates said clamper on a transportation surface of said lenticular sheet; and a rotation controller which controls said rotation mechanism based on the detection result from said lens sensor so that the longitudinal direction of said lenticular lens becomes parallel to the main-scanning direction, wherein said lens sensor detects an image of said reference lines observed through said lenticular sheet, and wherein said rotation controller corrects the oblique transportation of said lenticular sheet by rotating said clamper with reference to output from said lens sensor so that a moire observed with said image is disappeared.

16. A printer claimed in claim 15, wherein said lens detector drives said sheet transporter to transport said lenticular sheet to a position where the center of said lenticular lens coincides with said reference line such that a center in the sub-scanning direction of an image of said reference lines detected by said lens sensor has the highest density, after the oblique transportation of said lenticular sheet is corrected by said rotation controller, so that said position is used as a reference for obtaining a positional relationship between said lenticular sheet and said thermal head, and calculates a transportation length corresponding to one cycle of change of density distribution of said image, as a lens pitch.

17. A printer comprising:

a sheet transporter which includes a clamper for clamping an edge of a lenticular sheet having a plurality of lenticular lenses and moves said clamper in a sub-scanning direction for transporting said lenticular sheet;

a recorder having a recording head for recording lines elongated in a main-scanning direction on a rear side of said lenticular sheet, and recording said lines sequentially in synchronization with the transportation of said lenticular sheet, such that an image is recorded on the rear side of said lenticular sheet;

a rotation mechanism which rotates said clamper on a transportation surface of said lenticular sheet; and a rotation controller which optically detects an inclination of a longitudinal direction of said lenticular lens on said lenticular sheet clamped by said clamper from the main-scanning direction, and controls said rotation mechanism based on the detection result so that the longitudinal direction of said lenticular lens becomes parallel to the main-scanning direction.

18. A printer claimed in claim 17, further comprising:

a lens sensor having first to third sensors which are arranged in the main-scanning direction between said recording head and said clamper, each of said first to third sensors optically detecting said lenticular sheet and outputting detection signal according to which position on a concave-convex surface of said lenticular sheet, with an interval between said first and second sensors determined such that a displacement length between detection positions of said first and second sensors against said lenticular sheet does not reach a length equal to or more than one lens pitch regardless of a degree of oblique transportation of said lenticular sheet, wherein said rotation controller performs following steps of:

identifying detection signal, which represents that said third sensor detects a specific place arbitrarily selected on said lenticular lens which is previously detected by said first sensor, based on a transportation length from a point when said first sensor detects said specific place to a point when said second sensor outputs detection signal which represents that said second sensor detects said specific place, the interval between said first and second sensors, and an initial lens pitch;

calculating an oblique transportation angle of said lenticular sheet based on a transportation length from the point when said first sensor detects said specific place to a point when said third sensor outputs detection signal which represents that said third sensor detects said specific place, and an interval between said first and third sensors; and correcting the oblique transportation by rotating said clamper based on said oblique transportation angle.

19. A printer claimed in claim 17, wherein said rotation controller has a reference line parallel to the main-scanning direction and an oblique transportation sensor facing to said reference line through said lenticular sheet for detecting an image observed through said lenticular sheet, and corrects the oblique transportation of said lenticular sheet by rotating said clamper with reference to output from said oblique transportation sensor so that a striped pattern observed as said image is disappeared.

20. A printer claimed in claim 19, wherein a width of said reference line is narrower than the lens pitch.

21. A printer claimed in claim 19, wherein said oblique transportation sensor is positioned between said recording head and said clamper.

22. A printer claimed in claim 21, further comprising:

a displacement angle detector which records a test image elongated in the main-scanning direction and having a certain width in the sub-scanning direction on a transparent recording sheet by said recording head while said sheet transporter transports said recording sheet clamped by said clamper, and then detects a displacement angle between said reference line and the main-scanning direction based on a difference between a transportation length until said test image reaches a measurement point determined on said reference line and a transportation length until said test image reaches another measurement point determined on said reference line, and an interval between the two measurement points; and a memory for storing said detected displacement angle, wherein said rotation controller corrects a rotational position of said clamper with use of said displacement angle stored in said memory.

23. A printer claimed in claim 17, further comprising:

a lens sensor which is positioned between said recording head and said clamper and optically detects said lenticular sheet; and reference lines arranged in the sub-scanning direction with an interval narrower than the lens pitch and are parallel to the main-scanning direction, each of which faces to said lens sensor and has a width narrower than the lens pitch, wherein said lens sensor detects an image of said reference lines observed through said lenticular sheet, and wherein said rotation controller corrects the oblique transportation of said lenticular sheet by rotating said clamper with reference to output from said lens sensor so that a moire observed with said image is disappeared.

24. A printing method for recording linear images extended along a main-scanning direction and arranged along a sub-scanning direction on a rear side of a lenticular sheet sequentially in synchronization with transportation of said lenticular sheet in the sub-scanning direction, such that a thermal head extended along the main-scanning direction heats a rear side of an ink film putted on the rear side of said lenticular sheet so that ink is sublimated from said ink film and adhered on the rear side of said lenticular sheet, said printing method comprising a step of:

calculating a lens pitch by optically detecting an area between a clamper and said thermal head on said lenticular sheet which is clamped by said clamper which moves for transporting said lenticular sheet and is pressed by said thermal head.

25. A printing method claimed in claim 24, wherein said clamper, which clamps an edge of said lenticular sheet and transports said lenticular sheet in the sub-scanning direction, is rotated based on the detection result so that a longitudinal direction of said lenticular lens becomes parallel to the main-scanning direction.

26. A printing method for recording linear images extended along a main-scanning direction and arranged along a sub-scanning direction on a rear side of a lenticular sheet sequentially in synchronization with transportation of said lenticular sheet in the sub-scanning direction by a recording head for recording said linear images in a rear side of said lenticular sheet, said printing method comprising a step of:

optically detecting an inclination of a longitudinal direction of said lenticular lens from the main-scanning direction, and rotating a clamper which clamps an edge of said lenticular sheet and transports said lenticular sheet in the sub-scanning direction, so that the longitudinal direction of said lenticular lens becomes parallel to the main-scanning direction.

* * * * *